US011007634B1

(12) United States Patent
Tortorella, Jr.

(10) Patent No.: US 11,007,634 B1
(45) Date of Patent: May 18, 2021

(54) ORGANIZER AND WALL MOUNT FOR ORGANIZER

(71) Applicant: Frank J. Tortorella, Jr., Park Ridge, IL (US)

(72) Inventor: Frank J. Tortorella, Jr., Park Ridge, IL (US)

( * ) Notice: Subject to any disclaimer, the term of this patent is extended or adjusted under 35 U.S.C. 154(b) by 47 days.

(21) Appl. No.: 16/051,439

(22) Filed: Jul. 31, 2018

Related U.S. Application Data

(60) Provisional application No. 62/592,222, filed on Nov. 29, 2017, provisional application No. 62/630,177, filed on Feb. 13, 2018.

(51) Int. Cl.
*B25H 3/02* (2006.01)
*B25H 3/04* (2006.01)

(52) U.S. Cl.
CPC ..... *B25H 3/02* (2013.01); *B25H 3/04* (2013.01)

(58) Field of Classification Search
CPC . B25H 3/02; B25H 3/023; B25H 3/00; B25H 3/04; B25H 3/025
USPC ..... 206/373, 372
See application file for complete search history.

(56) References Cited

U.S. PATENT DOCUMENTS

| | | | | |
|---|---|---|---|---|
| 2,125,856 A * | 8/1938 | De Witt | B65D 25/04 | 220/532 |
| 4,884,689 A * | 12/1989 | Su-Chin | A45C 13/02 | 206/372 |
| 6,082,539 A * | 7/2000 | Lee | A45C 7/0045 | 206/1.5 |
| 8,267,247 B1 * | 9/2012 | Horiyama | B25H 3/025 | 206/373 |
| 8,602,217 B2 * | 12/2013 | Sosnovsky | B65D 21/0228 | 206/508 |
| 8,893,915 B2 * | 11/2014 | Vargas | B65D 25/08 | 220/549 |
| 2012/0111750 A1 * | 5/2012 | Phillips | B65D 25/22 | 206/338 |
| 2015/0352709 A1 * | 12/2015 | Diamond | B25H 3/003 | 206/350 |

* cited by examiner

*Primary Examiner* — Steven A. Reynolds

(57) ABSTRACT

An organizer includes a base, a cover having a proximal end rotatably connected to a proximal end of the base and a central connector disposed to releasably connect a central portion of a distal end of the cover to a central portion of a distal end of the base, the central connector including a living hinge formed at a connection between the central connector and the cover.

10 Claims, 12 Drawing Sheets

ORGANIZER AND WALL MOUNT FOR ORGANIZER

This application claims priority to U.S. Provisional Patent Application Ser. No. 62/592,222, which was filed on Nov. 29, 2017, the contents of which are incorporated herein by reference in their entirety.

BACKGROUND

Toolboxes house tools, as well as smaller parts and accessories (e.g., nails, screws, fasteners, washers, electrical connectors, electrical tape, drill bits, toggle bolts, anchors, etc.), in one or more drawers or trays, which may include partitions to define subsections in which the tools, parts and accessories may be disposed.

Figure 1:
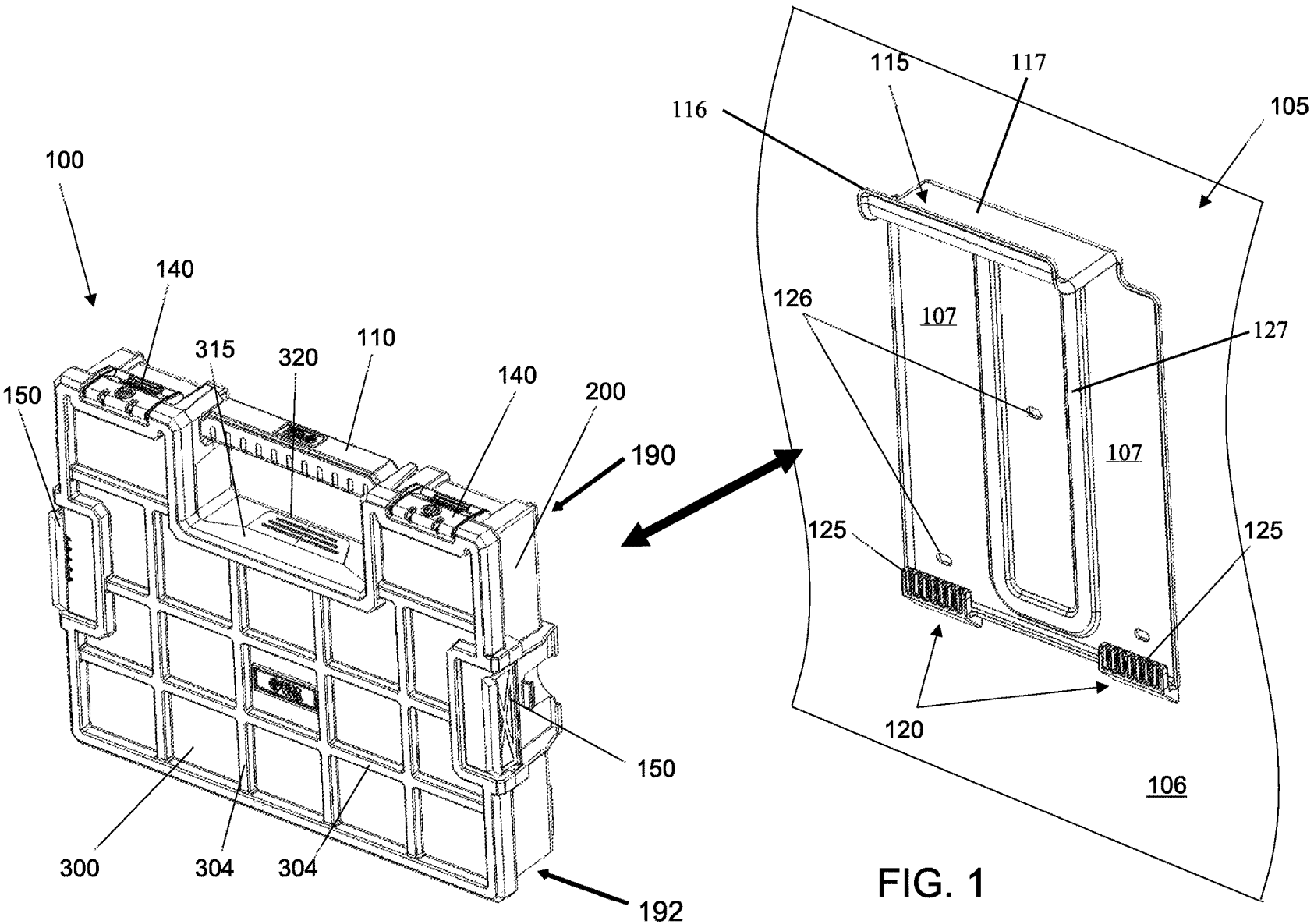
FIG. 1 is a perspective view of an example organizer, in accord with some aspects of the disclosure, disposed adjacent an example wall mount, in accord with some aspects of the disclosure, to which the example organizer is able to be selectively attached or selectively detached.

The figures are not necessarily to scale. Wherever possible, the same reference numbers will be used throughout the drawing(s) and accompanying written description to refer to the same or like parts. As used herein, stating that any part is in any way positioned on (e.g., positioned on, located on, disposed on, etc.) another part, indicates that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

In some aspects, this disclosure relates to an organizer system, and more particularly to an organizer (e.g., for tools, components, small parts, accessories, hobby parts, odds and ends, etc.), and still more particularly to an organizer having a vertical form factor (e.g., a height greater than a depth, a height significantly greater than a depth, etc.). In some examples, this disclosure relates to a wall mounted organizer system, and more particularly to a wall mounted organizer system including a wall mount configured to removably receive and store an organizer, and still more particularly to a wall mounted organizer system including a wall mount configured to removably receive and store an organizer having a vertical form factor.

Figure 2:
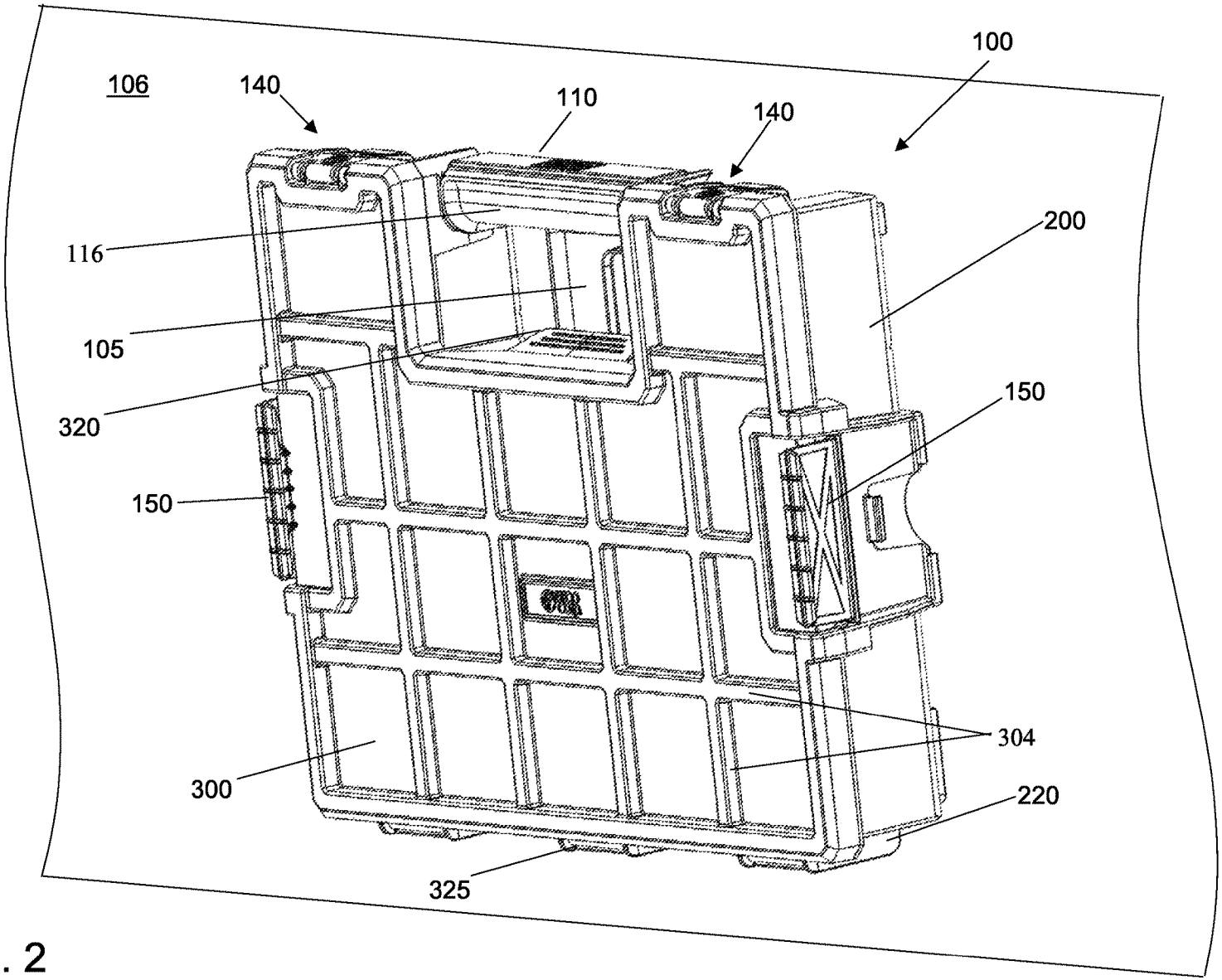
FIG. 2 is a perspective view of the example organizer attached to the example wall mount.
Figure 3:
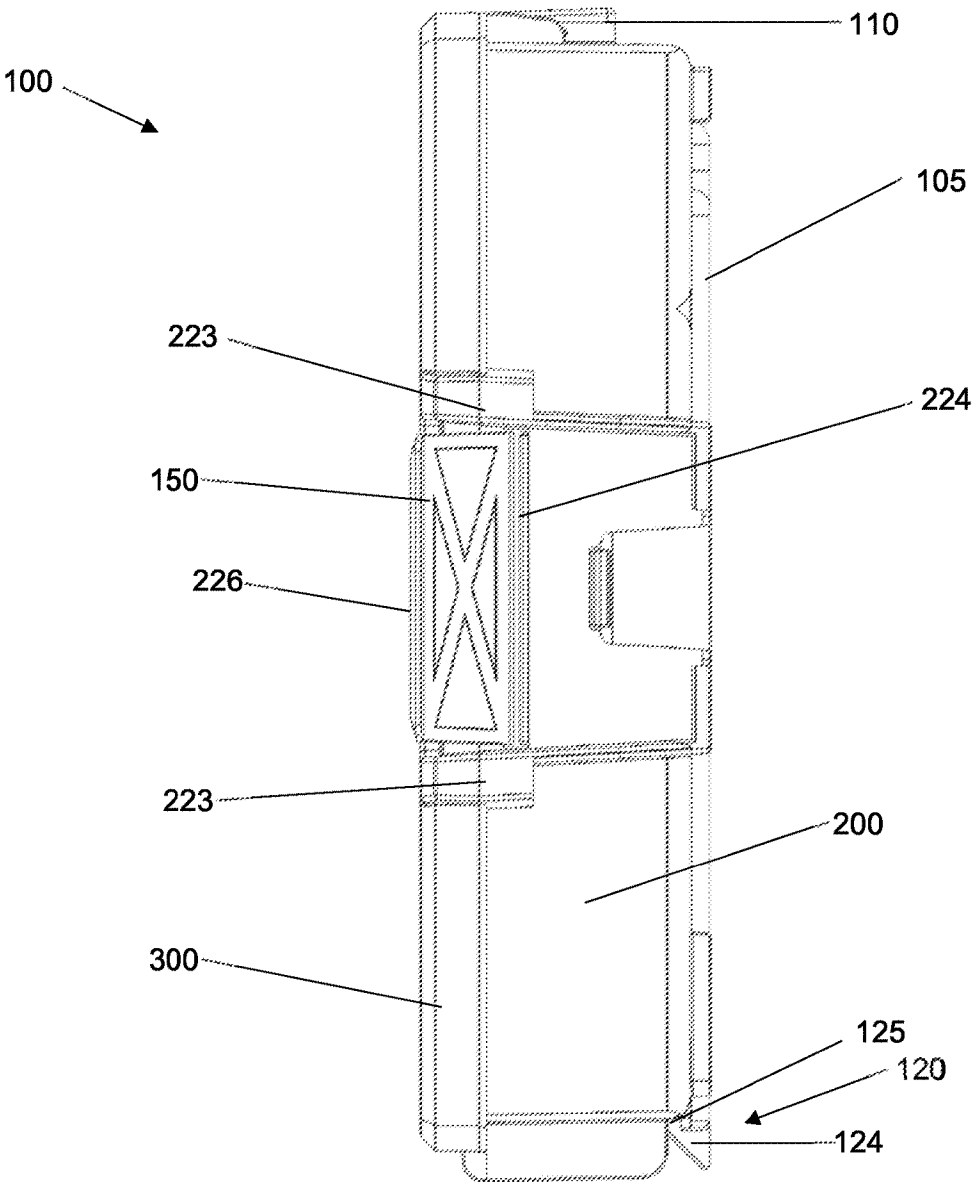
FIG. 3 is an example side view of the example organizer attached to the example wall mount.

FIGS. 1-3 are example perspective views of an example organizer 100 disposed adjacent an example wall mount 105 mounted on an example wall 106. The example organizer 100 is selectively attached to or selectively detached from the example wall mount 105 by a user. In some examples, the example wall 106 includes a wall of a home, business, or building. In some examples, the example wall 106 includes an upright or an inclined surface (e.g., vertical or non-vertical, a positively inclined surface, a negatively inclined surface, etc.) of any type such as, but not limited to, an interior wall of a work vehicle (e.g., a utility van, etc.), a partition or a work station.

The example organizer 100 of FIG. 1, and FIGS. 2-3, is shown to include an example base 200 and an example cover 300 matingly engaged to the example base 200. In the example of FIGS. 1-3, the example base 200 is matingly engaged to the example cover 300 via one or more (e.g., two, three, etc.) example hinges 202 along a side of the example organizer 100, as is shown by way of example in FIG. 2. In some examples, the example hinges 202 are external hinges, such as is shown in the example organizer 100 of FIG. 2. In some examples, the example hinges 202 are internal hinges.

The example organizer 100 of FIG. 1-3 is also shown to include an example handle 110, example lateral connectors 140, example side connectors 150 and an example center connector 315 disposed at a central portion of the example organizer 100. In some examples, one or more of the example lateral connectors 140, the example side connectors 150 and/or the example central connector 315 are attached to the example base 200. In some examples, one or more of the example lateral connectors 140, the example side connectors 150 and/or the example central connector 315 are attached to, or integral with (e.g., formed as part of, permanently affixed to, etc.) the example cover 300. The combination of the example lateral connectors 140 and the example center connector 315 of the example organizer 100 provides a robust, positive lock-up of the example cover 300 to the example base 200. In some examples, the example organizer 100 omits the example lateral connectors 140 and/or the example side connectors 150.

In some examples, one or more of the example lateral connectors 140, the example side connectors 150 and/or the example central connector 315 comprise a mechanical closure such as, but not limited to, a latch, a mechanical fastener, a linkage, a magnet (e.g., a rare-earth magnet, a neodymium magnet, etc.), a snap connector, a clasp, a quick release fastener or a slide lock. In the example of FIGS. 1-3, the example lateral connectors 140 include latches, the example side connectors 150 include latches and the example central connector 315 includes an example snap connector.

FIGS. 1-2 show an example wherein the central connector 315 includes an example hinge connecting the example central connector 315 to the example cover 300 and includes an example tab 320 to facilitate a user's outward biasing of the example central connector 315 relative to the example base 200 and the example cover 300 to disengage the example mechanical closure or feature (e.g., a snap connector, a ledge, a strike, a protrusion or boss, a recess, etc.) of the example central connector 315 from a corresponding mechanical closure or feature (e.g., another of a snap connector, a ledge, a strike, a protrusion or boss, a recess, etc.), which may be continuous or discontinuous, on the example base 200. In some examples, the example hinge is a living hinge. In some examples, the example central connector 315 is a separate part from the example cover 300 and the example central connector includes a first hinge element (e.g., a shaft, etc.) that is attached to corresponding second hinge element (e.g., a knuckle, a loop, joint, a node, etc.) of the example cover 300, with a spring or resilient element biasing the example central connector 315 inwardly to facilitate the automatic engaging of the example mechanical closure of the example central connector 315 with the corresponding mechanical closure or feature on the example base 200.

Figure 10A:
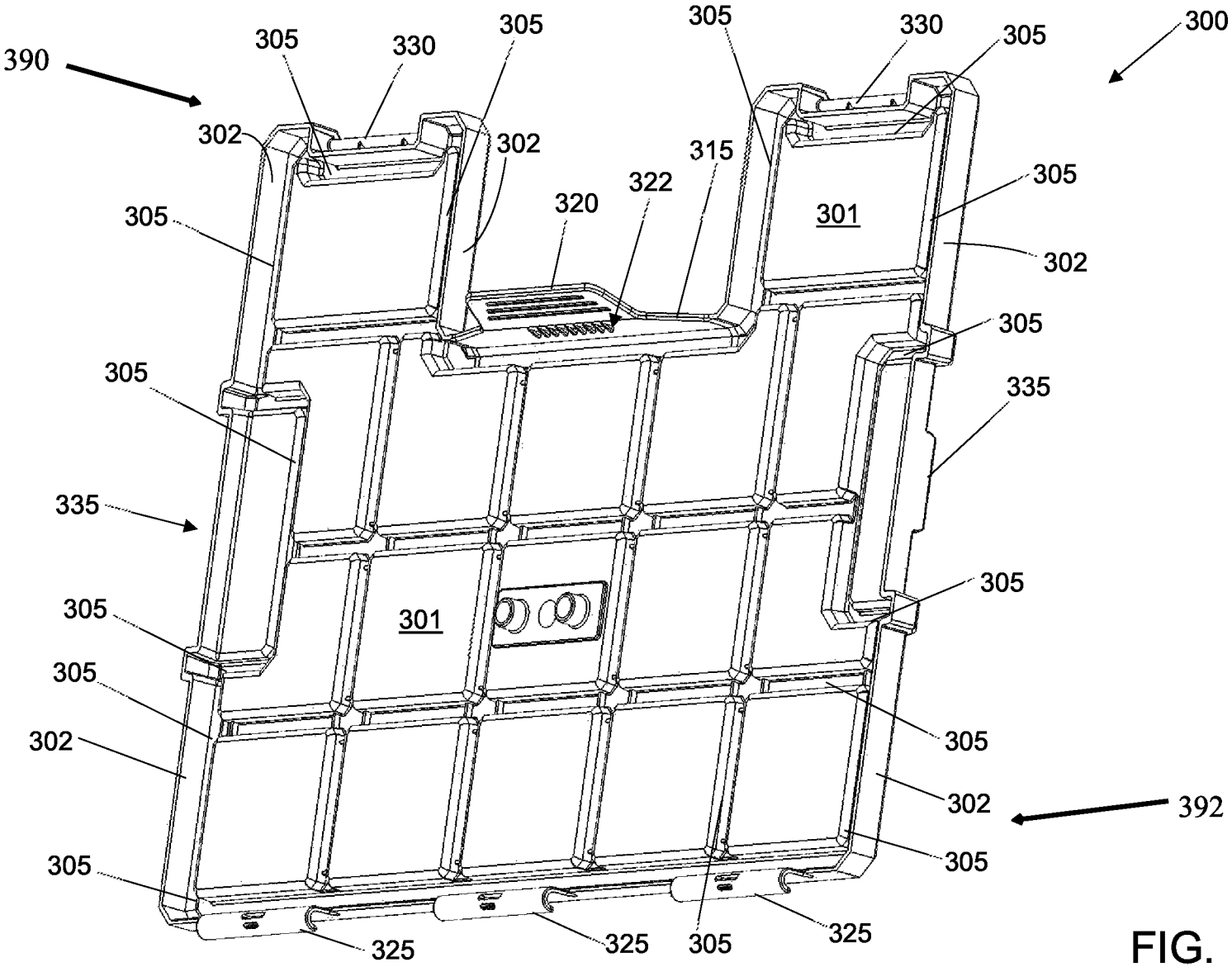
FIG. 10A is an example perspective view of an example cover to matingly engage the example base structure of the example organizer of FIGS. 1-5.
Figure 10B:
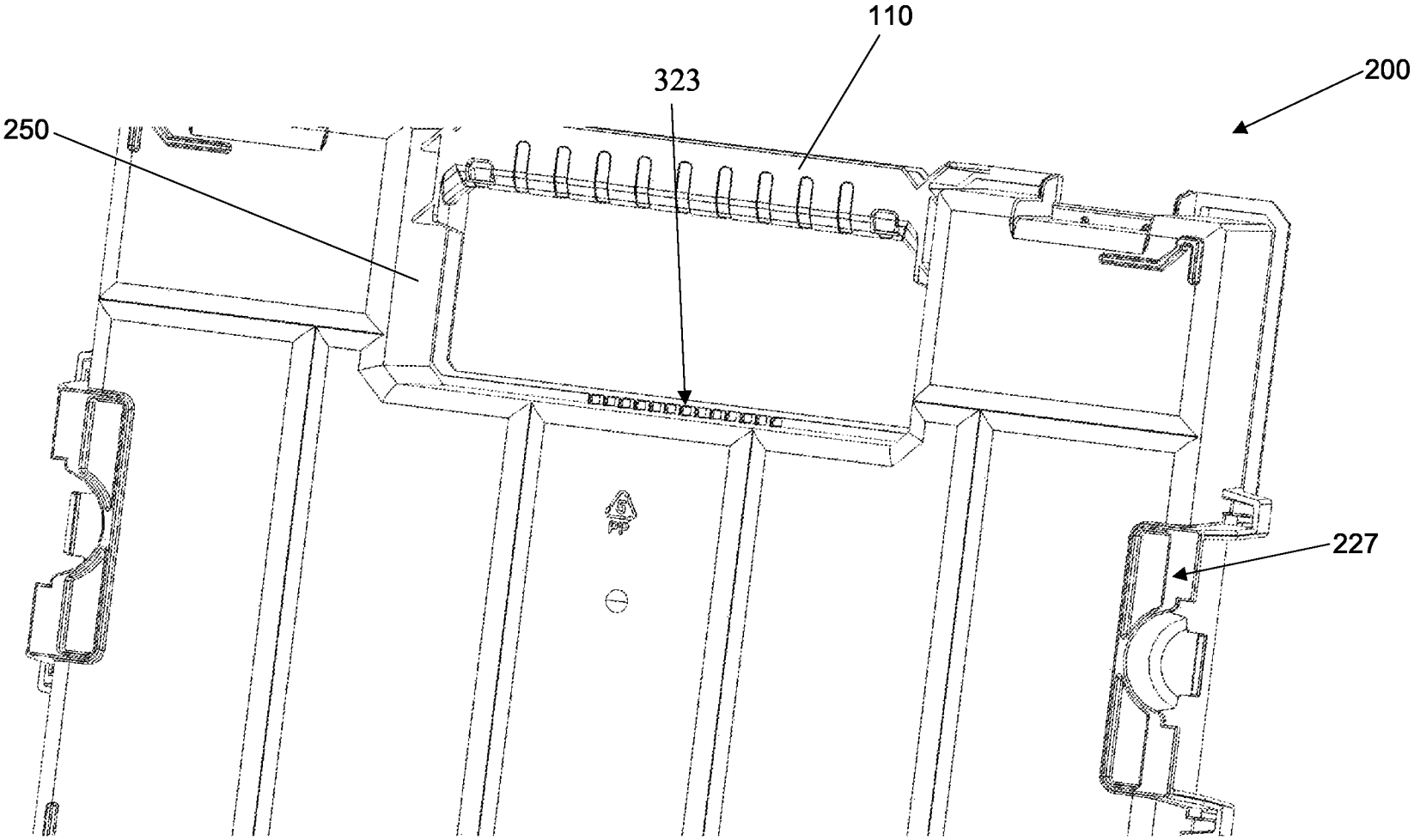
FIG. 10B is another example perspective view of an example base structure of the example organizer of FIGS. 1-5.

In some examples, the example central connector 315 extends at least substantially perpendicularly (e.g., 89°, 90°, 91° etc.) to the example base 301 (e.g., the plane generally defining the example cover 300) of the example cover 300, such as is shown in FIGS. 1, 10A. In some examples, the example central connector 315 is canted outwardly relative to the example base 301, such as at an outwardly directed angle from the perpendicular of between about 0°-5° (e.g., 91°, 92°, 93°, 94°, 95°, etc. relative to the example base 301) or more. In some examples, the example central connector 315 is canted inwardly relative to the example base 301, such as at an inwardly directed angle from the perpendicular of between about 0°-5° (e.g., 89°, 88°, 87°, 86°, 85°, etc. relative to the example base 301) or more. In some examples, the example tab 320 is canted outwardly relative to the example central connector 315 (e.g., away from example base 200 and the example cover 300 with the example organizer 100 in a closed position), such as at an angle between about 0°-30°, to facilitate digital manipulation of the example tab 320 by a user when opening the example organizer 100. In some examples, the example mechanical closure (see, e.g., the example snap connector 322 in FIG. 10) is integrated with the example tab 320 rather than the example central connector 315. In closure, a user is able to simply rotate the example cover 300 toward and into engagement with the example base 200 and the example central connector 315, or the example tab 320, automatically engages and locks onto the example base 200 to securely and independently (e.g., without engagement of the example lateral connectors 140 and/or the example side connectors 150) retain the example cover 300 in engagement with the example base 200. For instance, the example first connector(s) 322 of the example central connector 315 engage(s) the example second connector(s) 323 of the example base 200 (see FIG. 10B). In this state, with the example central connector 315, or the example tab 320, locked onto the example base 200 via the mechanical closure, the example organizer can be oriented in another position (e.g., a vertical position as shown in FIG. 2, etc.) and the example cover 300 will remained locked to the example base 200 even if the example lateral connectors 140 and/or the example side connectors 150 are not provided or are not engaged.

The example in the following paragraphs relates to an example organizer similar to that of the example of FIGS. 1-3, but some components are positioned differently than in the example organizer 100 of FIGS. 1-3. For clarity, in the example that follows, the reference numerals of the example of FIGS. 1-3 (e.g., base 200) are used with a prime indicator (e.g., base 200') to connote that the structures of the example that follows are essentially the same as that of the example of FIGS. 1-3, but are disposed on a different part of an example organizer 100' than that of the example organizer 100 shown in FIGS. 1-3. In the example that follows, an example central connector 315' (not shown) is connected to an example base 200' (not shown) and an example cover 3M' (not shown) includes the corresponding mechanical closure or feature (e.g., a snap connector, a ledge, a strike, a protrusion or boss, a recess, etc.), continuous or discontinuous, with which the example central connector 315' of the example base 200' engages.

In some examples, the example central connector 315' is connected to the example base 200' via a hinge such as, but not limited to, a living hinge. In some examples, the example central connector 315' is a separate part from the example base 200' and the example central connector includes a first hinge element (e.g., a shaft, etc.) that is attached to corresponding second hinge element (e.g., a knuckle, a loop, joint, a node, etc.) of the example base 200' with a spring or resilient element biasing the example central connector 315' inwardly to facilitate the automatic engaging of the example mechanical closure of the example central connector 315' with the corresponding mechanical closure or feature on the example cover 300'. In some examples, the example central connector 315' includes an example tab 320' canted outwardly relative to the example central connector 315' by an angle between about 0°-30°. The example tab 320' facilitates a user's outward biasing of the example central connector 315' relative to the example base 200' and the example cover 300' to disengage the example mechanical closure or feature (e.g., a snap connector, a ledge, a strike, a protrusion or boss, a recess, etc.) of the example central connector 315' from a corresponding mechanical closure or feature (e.g., another of a snap connector, a ledge, a strike, a protrusion or boss, a recess, etc.) on the example cover 300'.

In some examples, the example central connector 315' extends parallel to or substantially parallel to the example outer side walls 250' of the example base 200'. In some examples, the example central connector 315' extends upwardly to a point above an upper edge of the example outer side walls 250' of the example base 200'. In some examples, the example central connector 315' is attached to, or integrated with, the example base 200' in an outwardly canted orientation relative to the example base 200' and the example cover 300' (e.g., canted at an angle between about 0°-15°, etc.) to facilitate digital manipulation by a user. In some examples, the example central connector 315' is canted outwardly slightly relative to the outer side walls 250', such as at an outwardly directed angle of between about 0°-5° or more relative to the example outer side walls 250'. In some examples, the example central connector 315' is connected to a respective one of the example outer side walls 250' (e.g., an outer side wall positioned adjacent the example handle 110') via a living hinge at a proximal end of the example central connector 315', the proximal end being displaced outwardly from the respective one of the example outer side walls 250' via an offset. In this example, the example central connector 315' is canted inwardly relative to the respective one of the example outer side walls 250' (e.g., at an inwardly directed angle of between about 0°-5°), such that a spacing between at least a portion of a distal end of the example central connector 315' and the respective one of the example outer side walls 250' is less than a spacing between the example proximal end of the example central connector 315' and the respective one of the example outer side wall 250'.

In some examples, as shown by way of example in FIGS. 1-3, the example cover 300 includes example features 304. In some examples, the example features 304 are raised features, projecting above a base height of the example cover 300, defining channels on an underside of the cover (not shown in FIGS. 1-3). In some examples, the example features 304 are recessed features, extending below a base height of the example cover 300, defining projections on an underside of the cover. The example features 304 are described in relation to FIG. 10A. In summary, the channels defined by the example features 304 engage corresponding features (e.g., projections, male connectors, recesses, female connectors, etc.) of fixed and/or removable partitions, and/or junctions or posts therebetween, disposed to define a plurality of separate compartments within the example base 200. The engagement between the channels formed by the example features 304 and the corresponding features of that partitions and/or junctions provide additional points of contact between and/or connection between, the example cover 300 and the example base 200 when the cover is in a closed position. Additionally, the enhanced engagement between the channels formed by the example features 304 and the corresponding features of that partitions and/or junctions could help to prevent migration of small parts borne within the one or more compartments in the example organizer 100 when the example cover 300 is in a closed position.

Turning to the example wall mount 105 of FIGS. 1-3, the example wall mount 105 includes an example base 107 that is attached to the example wall 106 or other inclined surface (e.g., a panel, a hutch, a pegboard, a partition, etc.). An upper portion of the example wall mount 105 includes an example receiver 115 extending outwardly from the example base 107 (e.g., away from the example wall 106 or other surface to which the example wall mount 105 is attached) to receive a handle (e.g., example handle 110 of the example organizer 100 of FIGS. 1-3, etc.) thereupon. The example receiver 115 may extend perpendicularly from the example base 107, substantially perpendicularly from the example base 107 (e.g., 88°, 89°, etc.), or at an upward cant (e.g., 60°, 75°, 80°, etc.) or a downward cant (e.g., 60°, 75°, 80°, etc.) relative to the example base 107.

In some examples, the example receiver 115 includes an example retainer 116 at an example distal end of an example base 117. In some examples, such as is shown in FIGS. 1-2, the example retainer 116 includes one or more upwardly curving sections. In some examples, the example retainer 116 includes one or more upwardly extending sections or members (e.g., posts, pins, plates, etc.). The example retainer 116 is to prevent forward movement of the handle (e.g., 110) of the organizer (e.g., 100) away from the example base 107 of the example wall mount 105 and off of the example receiver 115. In some examples, the example retainer 116 includes one or more upwardly extending sections or members (e.g., male connectors) corresponding in dimension and placement to matingly engage recessed sections (e.g., female connectors) or other features in a handle of an organizer or in a common handle configuration used for a family of organizers. In some examples, the retainer 116 includes one or more recessed areas (e.g., grooves, slots, cutouts, recesses, etc.) corresponding in dimension and placement to matingly engage one or more portions in a handle of an organizer or in a common handle configuration used for a family of organizers. For instance, in some examples, the retainer 116 includes a semi-cylindrical recess having a first diameter, dimensioned to receive a handle having a second diameter that is less than the first diameter. In some examples, the retainer 116 may include a combination of one or more upwardly extending sections or members and one or more recessed areas. In the example of FIGS. 1-3, the example retainer 116 upwardly curves from the example base 117. In some examples, this upward curve corresponds generally to a curve of a handle of an organizer, or family of organizers, that are mated with, or intended to be used with, the example wall mount 105.

FIGS. 1-2 show that the example base 107 of the example wall mount 105 includes one or more example openings 126, such as holes (e.g., circular openings, etc.) to facilitate use of conventional mechanical fasteners (e.g., screws, nuts, nails, rivets, etc.) to secure the example base 107 of the example wall mount 105 to the example wall 106 or other inclined surface. In some examples, the one or more example openings 126 include slots (e.g., oblong openings, etc.) to further facilitate additional degrees of freedom in positioning of the mechanical fasteners relative to structures (e.g., studs, supports, etc.) of the example wall 106 or other inclined surface.

In some examples, the example base 107 includes one or more example features 127 including one or more male features (e.g., an example ridge or protrusion in the example of FIG. 1) and/or one or more female features (e.g., an example recess, slot, groove, etc.). For instance, it the example of FIG. 1, the vertical aspects of the example features 127 may engage correspondingly oriented and dimensioned features (e.g., vertically oriented spaced-apart grooves, etc.) on a rear side of the example base 200.

In some examples, to secure a bottom portion of the example organizer 100 borne by the example wall mount 105, the example wall mount 105 includes one or more (e.g., two, three, etc.) example supports 120. In FIGS. 1-3, two spaced-apart example supports 120 are shown. In some examples, the example wall mount 105 includes one support 120 that may extend along an entire width of the example wall mount 105 or, alternatively, may extend only a portion of the width of the example wall mount 105 (e.g., a centrally-disposed support having one-half, one-third, one-quarter, or other fractional portion of the width of the example wall mount 105). In some examples, three supports 120 are provided, with two laterally disposed supports (e.g., as shown in FIGS. 1-2) and one centrally disposed support.

In some examples, the example supports 120 engage a bottom portion of the example organizer 100 borne by the example wall mount 105. In some examples, the example supports 120 include example first connectors 125 to matingly engage example second connectors 270 on the bottom portion of the example organizer 100 to limit or prevent motion of the bottom portion of the example organizer along one or more axes (translational and/or rotational). In some examples, the example first connectors 125 and the example second connectors 270 may include male-female connectors (e.g., spike and cone, pin and socket, boss and indentation, etc.), snap-fit connectors, frictional engagement surfaces, magnetic connectors or biasing elements (e.g., spring assisted pins, etc.). In the example of FIGS. 1-2, the example first connectors 125 include male connectors projecting upwardly from the example supports 120 and the example second connectors 270 include female connectors comprising recesses formed within the example base 200 to receive the example first connectors 125. While in some examples the example supports 120 and/or the example first connectors 125 are similar in configuration in the example of FIGS. 1-3, the example supports 120 and/or the example first connectors 125 may be dissimilarly configured. In some examples of the present concepts, the example first connectors 125 and the example second connectors 270 are omitted.

In some examples of the present concepts, the example supports 120 are omitted and the engagement of the example organizer 100 with the example wall mount 105 is via the example handle 110. In some examples, the example supports 120 are positioned on one or more different portions of the example wall mount 105 so as to engage correspondingly positioned features (e.g., second connectors 270) formed on the example base 200 of the example organizer 100. For instance, the example supports 120 can be positioned on lateral portions of the example wall mount 105 to engage example second connectors positioned on lateral portions of the example base 200. As another example, the example supports 120 can be positioned on the example base 107 of the example wall mount 105 to engage example second connectors positioned on an example rear portion 205 (see, e.g., FIG. 4) of the example base 200.

FIG. 2 is a perspective view of the example organizer 100 attached to the example wall mount 105. The example handle 110 of the example organizer 100 is nestled on the example base 117 of the example receiver 115 and is displaced adjacent or in contact with the example retainer 116. In the perspective of FIG. 2, example hinges 325 on the example cover 300 connect the example cover 300 to the example base 200. In the example of FIG. 2, the example organizer 100 includes three separated example hinges 325. In other examples, a lesser number (e.g., one or two) or a greater number (e.g., four, etc.) of hinges are provided. For instance, a single hinge extending along substantially an entire width of the example cover 300 and the example base 200 may be used to rotatably connect the example cover 300 and the example base 200.

FIG. 3 is an example side view of the example organizer 100 attached to the example wall mount 105. FIG. 3 shows the connection between the example first connectors 125 of the example supports 120 and the example second connectors 270 (not shown) of the example organizer 100. The example supports 120 are also shown to include an example angled support 124.

FIG. 3 also shows the example side connector 150 to include, at a bottom portion thereof, an example shaft 224 defining an axis of rotation about which the example side connector 150 rotates. In some examples, the example side connector 150 includes lateral spindles or pins in lieu of the example shaft 224. A first end of the example shaft 224 is rotatably received within an example first opening or slot (not shown in FIG. 3) formed in an example hinge support 223 and a second end of the example shaft 224 is rotatably received within an example second opening or slot (not shown in FIG. 3) formed in another example hinge support 223. Thus, in the example shown in FIG. 3, the example side connector 150 rotates relative to the example base 200 and connects to the example cover 300 via an example connector 226 (e.g., a snap connector, etc.) at an upper end of the example side connector 150.

Figure 4:
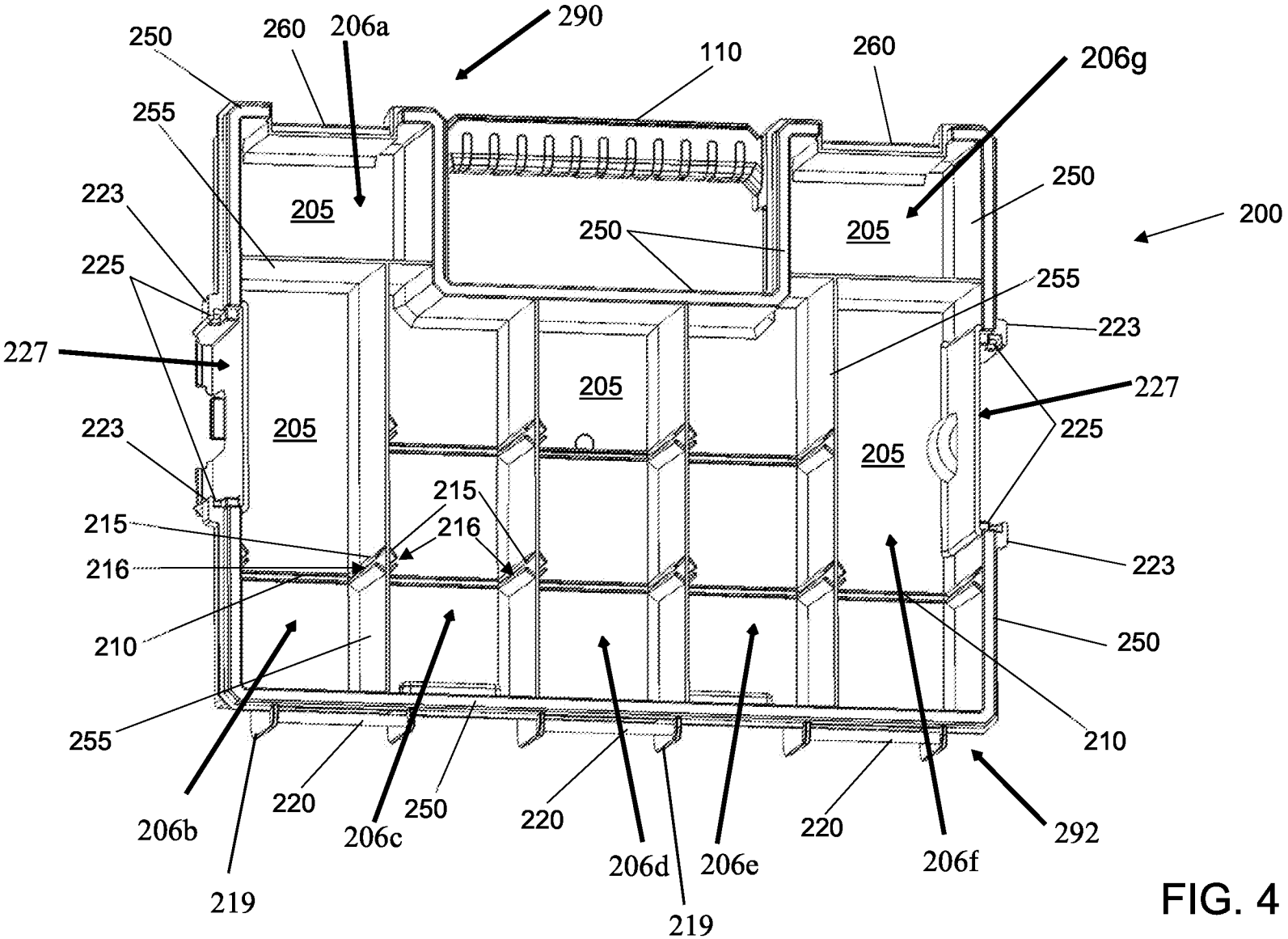
FIG. 4 is an example perspective view of an example base of the example organizer in an example first configuration having an example first predetermined arrangement of compartments.

FIG. 4, an example perspective view of the example base 200 of the example organizer 100, shows the example base 200 to define example recesses 227 to receive the example side connectors 150 and to define example hinge supports 223. The example hinge supports 223 define therein example openings 225 (e.g., slots holes, etc.) to receive and retain the example shaft 224, or example lateral spindles or pins, of the example side connectors 150, while permitting rotational movement of the example side connectors 150 relative to the example openings 225 and the example base 200.

FIG. 4 is an example first configuration of the example base 200 of the example organizer 100 showing an example first predetermined arrangement of compartments **206*a*-206*g* defined by the example rear portion 205, example outer side walls 250 and example inner side walls 255 of the example base 200. In FIG. 4, the example inner side walls 255 are fixed walls. In the example of FIG. 4, the example organizer 100 includes in the example first predetermined arrangement of compartments 206*a*-206*g* consisting of seven compartments. In other examples, the example organizer 100 includes predetermined arrangement of compartments 206*a*-206*g*** consisting of less than seven compartments (e.g., one, two, three, etc.) or more than seven compartments (e.g., eight, nine, ten, etc.).

As shown in FIG. 4, in some examples, the example organizer 100 includes example features 210 (e.g., grooves, channels, slots, snap-fit connectors, male connectors, female connectors, holes, openings, etc.) formed in or on inner surfaces of (i.e., on an interior of the volume defined by the example base 200) the example rear portion 205 of the example organizer 100. These example features 210 may be continuous or discontinuous. In the example of FIG. 4, the example features 210 include female connectors, such as slots or grooves. The example base 200 of FIG. 4 also includes example features 215 (e.g., grooves, channels, slots, snap-fit connectors, male connectors, female connectors, etc.) formed in or on inner surfaces of (i.e., on an interior of the volume defined by the example base 200) the example outer side walls 250 and/or example inner side walls 255 of the example base 200. In some examples, the example features 215 include female connectors, such as slots or grooves. As shown in FIG. 4, the example features 215 include inwardly angled sidewalls defining an example slot 216 and an interior volume therebetween. In other examples, the example features 215 include sidewalls extending at least substantially perpendicularly to the example inner surfaces of the example outer side walls 250 and/or example inner side walls 255 of the example base 200, such sidewalls defining an example slot and an interior volume therebetween. While the above examples show use of female connectors for the example features 210, 215, any of the example features 210, 215 on any one or more of the example inner surfaces of the example outer side walls 250 and/or example inner side walls 255 of the example base 200 may include one or more male connectors (e.g., pins, ribs, etc.). Additionally, while the example features 210, 215, are shown to be continuous, the example features 210, 215 need not be continuous and may instead be discontinuous (e.g., in two or more discrete parts, etc.).

In the example base 200 of FIG. 4, the example compartment **206*a* and the example compartment 206*g* are fixed in shape and are not subdividable, whereas the example compartment 206*b* and the example compartment 206*f* each include one arrangement of example features 210, 215 constructed to receive a partition, described below, to subdivide each of the example compartment 206*b* and the example compartment 206*f* into two compartments. In the example base 200 of FIG. 4, the example compartments 206***c*-206*e* each include two arrangements of example features 210, 215 constructed to receive a partition, described below, to subdivide each of the example compartments 206*c*-206*e* into three compartments. In accord with the present concepts, the example base 200 may include any number of arrangements of example features 210, 215, each such arrangement (e.g., two example features 215 and one example feature 210, wherein the slot of the example features 215 are aligned with the slot of the example feature 210, etc.) constructed to receive a partition to subdivide a space within the example base 200.

At an example second end 292 of the example base 200 are example hinge walls 219 having example hinge bars 220 extending therebetween. To the example hinge bars 220 are attached corresponding example hinges 325 (e.g., rotational snap-fit connectors, etc.) of the example cover 300, enabling rotation of the example cover 300 about the example hinge bars 220. At an example first end 290 of the example base 200 are example strikes 260 (e.g., rib(s), protrusion(s), etc.) to which the example lateral connectors 140 latch.

It is to be emphasized that, while the example of FIG. 4 shows a particular size and shape of an example base 200, with a particular arrangement of example compartments 206*a*-206*g* and example features 210, 215 enabling selective partitioning of the interior volume of the example base 200, the base may be any size and shape and may include any number of and arrangement of example compartments and may include any manner of arrangements of example connectors enabling selective partitioning of the interior volume of the base using one or more partitions. In the example organizer 100 of FIGS. 1-5, the example base 200 may receive up to eight partitions to define up to fifteen compartments in the example first base 200.

Figure 5:
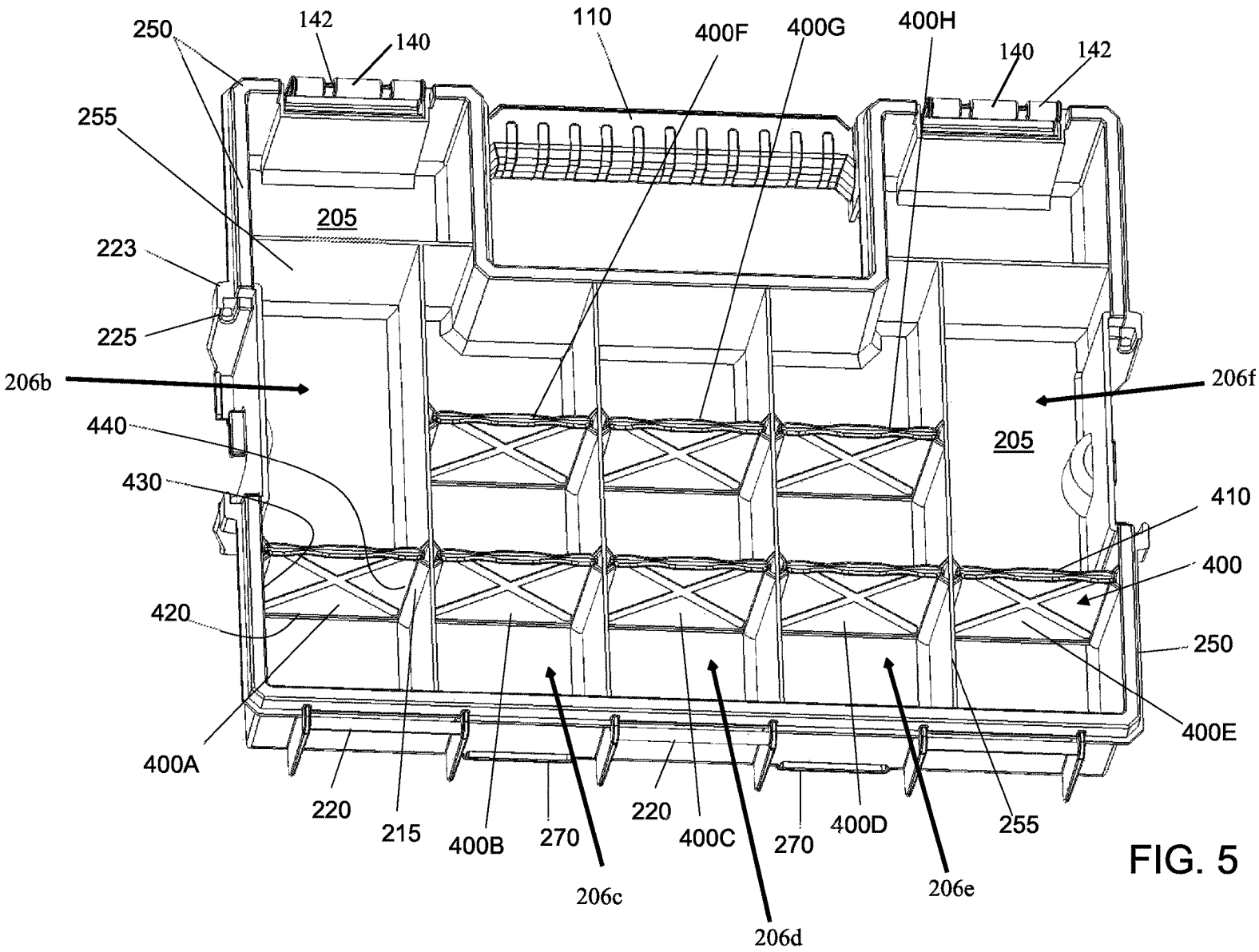
FIG. 5 is an example perspective view of an example base of the example organizer in an example second configuration wherein a plurality of example partitions are used to divide the example base of the example organizer into an example second predetermined arrangement of compartments.

FIG. 5 shows an example second configuration of the example base 200 of the example organizer 100 showing an example second predetermined arrangement. In this example second predetermined arrangement, compartment 206*b* is divided into two compartments via example partition 406A, compartment 206*c* is divided into three compartments via example partition 406B and example partition 406F, compartment 206*d* is divided into three compartments via example partition 406C and example partition 406G, compartment 206*e* is divided into three compartments via example partition 406D and example partition 406H, and compartment 206*f* is divided into two compartments via example partition 406E.

FIG. 5 also shows a view of the example lateral connectors 140. When the example organizer 100 is assembled, an upper portion of each example lateral connector 140 is rotatably connected to the example cover 300 and a lower or middle portion of the example lateral connectors 140 includes a latch (not shown in FIG. 5) to engage a corresponding one of the example strikes 260 (see FIG. 4) at the example first end 290 of the example base 200. With the example cover 300 removed in FIG. 5, the position and structure of the upper portion of the example lateral connectors 140 can be observed and, in particular, the example snap fit joint 142 having three example ring sections with an opening to enable the example snap fit joint 142 to be snapped onto a shaft formed on the example cover 300.

Accordingly, as shown in the example of FIGS. 4-5, the example removable partitions (e.g., 400A-400*n*, where n is any integer) are selectively connected to the example base 200 (e.g., via mating engagement of features such as slots, grooves, snap-fit connectors, female connectors, male connectors, etc.), or removed from the example base 200, to subdivide an interior volume of the example organizer 100 into a selected arrangement of compartments. In some examples, one or more of the inner side walls 255 of the example base 200 are selectively removable and include one or more features (e.g., male connectors, etc.) dimensioned and positioned to matingly engage one or more features (e.g., female connectors, etc.) of the example base 200 (e.g., grooves in the example outer side walls 250, grooves in the example rear portion 205, etc.).

Figure 6:
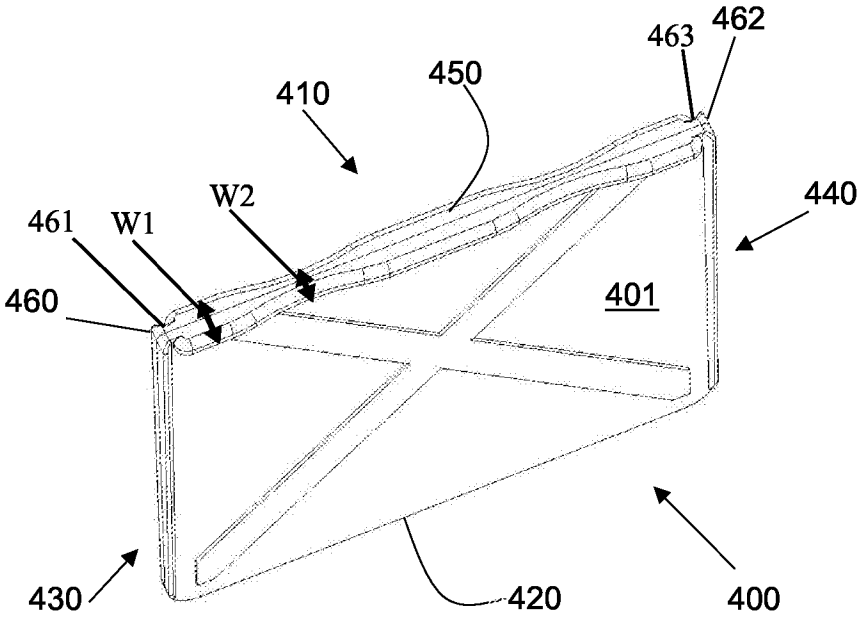
FIG. 6 is an example perspective view of an example partition to matingly engage features in at least the example base of the example organizer of FIGS. 1-5.

FIG. 6 is an example perspective view of an example partition 410 to matingly engage features in at least the example base 200 of the example organizer 100 of FIGS. 1-5. In some examples, the example partition 410 includes an example base 401. In some examples, the example base 401 includes an example lower portion 420, an example first lateral portion 430, an example second lateral portion 440 and an example upper portion 450. In some examples, the example base 401 is planar. In some examples, the example base 401 is curvilinear. In some examples, the example base 401 is tapered and has a greater thickness or depth at the example upper portion 450 and a lesser thickness or depth at the example lower portion 420, or vice versa.

In some examples, the example lower portion 420 is configured (e.g. a male connector, etc.) to matingly engage the example features 210 (e.g. a female connector, etc.) formed in or on inner surfaces of the example rear portion 205 of the example organizer 100. For instance, the example lower portion 420 is dimensioned to fit inside of the example features 210 to provide a locational clearance fit or a snap fit that is freely removable by hand. In some examples, the example lower portion 420 includes a downwardly depending tab dimensioned to matingly engage the example features 210. In some examples, the example lower portion 420 is to abut against the example rear portion 205 of the example organizer 100.

In some examples, the example upper portion 420 is configured (e.g. a male connector, etc.) to matingly engage the example features 304 formed in or on inner surfaces of the example cover 300 of the example organizer 100. For instance, the example upper portion 450 is dimensioned to fit inside of the channels formed by the example features 304 to provide a locational clearance fit or a snap fit that is freely disconnected by a rotation of the example cover 300 away from the example base 200. In some examples, a force required to disconnect the example upper portion 450 from the example feature 304 is less than a force required to disconnect the example lower portion 450 from the example feature 210, so as to ensure that rotational movement of the example cover 300 away from the example base 200 does not dislodge the example partitions 440 from the example features 210. In some examples, the example upper portion 450 is dimensioned to loosely fit inside of the channels formed by the example features 304 to provide laterally constraints on movement of the upper example upper portion 450 without interference with rotation of the example cover 300 away from the example base 200.

In some examples, the example upper portion 450 has a width that includes one or more portions having an example first width W1 and one or more portions having an example second width W2, with the example first width W1 being greater than the example second width W2. In some examples, such as is shown in the example of FIG. 6, the width of the example upper portion 450 undulates between the example first width W1 and the example second width W2 to provide multiple portions of the example upper portion 450 having the example first width W1. In some examples, the example upper portion 450 includes only a single portion having the example first width W1. While aspects of the example upper portion 450 are shown to have a generally curvilinear profile, the example first width W1 and the example second width W2 may be represented by a stepped profile in some examples.

In some examples, the example first width W1 is dimensioned to matingly engage the example channels 305 defined by the example features 304 formed in or on inner surfaces of the example cover 300 of the example organizer 100, whereas the example second width W2 is dimensioned not to matingly engage the example channels 305. For instance, the mating engagement between the example channels 305 and the example first width W1 includes a locational clearance fit or a snap fit along a length and a height of the portion(s) having the first width W1 or a width substantially equal thereto. In this manner, in some examples, the example upper portion 450 of the example partition 410 intermittently matingly engages the example channels 305 of the example cover 300 when the example cover 300 is in the closed position, with a mating engagement between the one or more first width W1 portions of the example upper portion 450 of the example partition 410 and the example channels 305 providing additional points of securement (e.g., surface area frictional contact) between the example partition 440 and the example cover 300 and with the one or more second portions of the example upper portion 450 having an example width W2 positioned and dimensioned to tailor the surface area of mating engagement (and associated frictional forces) between the example upper portion 450 and the example channels 305.

While the above examples relating to the example partition 440 of FIG. 6 discuss example channels 305 having a substantially cross-sectional profile and an example upper portion 450 of the example partition 440 having an example profile varying to tailor areas of contact between the example upper portion 450 and the example channels 305, the present concepts also include the converse, with the example channels 305 having a varying cross-sectional profile and a profile of the example upper portion 450 of the example partition 440 having a substantially cross-sectional profile to tailor areas of contact between the example upper portion 450 and the example channels 305.

In some examples, the example first lateral portion 430 and/or the example second lateral portion 440 of the example partition 440 are configured (e.g. a male connector, etc.) to matingly engage the example features 215 (e.g. a female connector, etc.) formed in or on inner surfaces of the example features 215 formed in or on inner surfaces of the example outer side walls 250 and/or example inner side walls 255 of the example base 200.

In the example of FIG. 5, the example first lateral portion 430 includes an example lateral connector 460 connected to the example partition 410 via an example bridge 461 having a width less than a width of the example slot 216 defined by the inwardly angled sidewalls of the example features 215. In FIG. 5, the example second lateral portion 440 includes an example lateral connector 462 connected to the example partition 410 via an example bridge 463 having a width less than a width of the example slot 216 defined by the inwardly angled sidewalls of the example features 215. Accordingly, in some examples, the example partition 400 is secured within the example base 200 by aligning the example first lateral portion 430 and the example second lateral portion 440 with the example the example features 215 such that the example bridges 461, 463 enter the example slots 216 and the example lateral connectors 460, 462 enter the spaces defined by the sidewalls of the example features 215. In some examples, the sidewalls of the example features 215 are inwardly angled to define a polygonal (e.g., triangular, etc.) space and the example lateral connector 460 and the example lateral connector 462 are a similar polygonal shape (e.g., triangular, etc.). In some examples, the example partition 400 is then moved downwardly until the example lower portion 420 matingly engages (e.g., seats within) the example feature 210. In some examples, where the example base 401 is curvilinear, the example bridges 461, 463 are disposed at an angle relative to the example base 401 enabling insertion of the example first lateral portion 430 and the example second lateral portion 440 (e.g., the example lateral connectors 460, 462, etc.) into the example features 215.

In some examples, the example first lateral portion 430 and/or the example second lateral portion 440 abut inner surfaces of the example outer side walls 250 and/or example inner side walls 255 of the example base 200 and are not matingly engaged therewith and securement of the example partition is via mating engagement of the example lower portion 420 of the example partition 410 and the example features 210 formed in or on inner surfaces of the example rear portion 205 and mating engagement of the example upper portion 450 of the example partition 410 with the channels formed by the example features 304 of the example cover 300. In some examples, the example first lateral portion 430 and/or the example second lateral portion 440 matingly engage the example features 215 formed in or on the inner surfaces of the example outer side walls 250 and/or example inner side walls 255 of the example base 200, and the example lower portion 420 and/or the example upper portion 450 of the example partition 410 do not respectively matingly engage the example rear portion 205 or the example cover 300.

Figure 7:
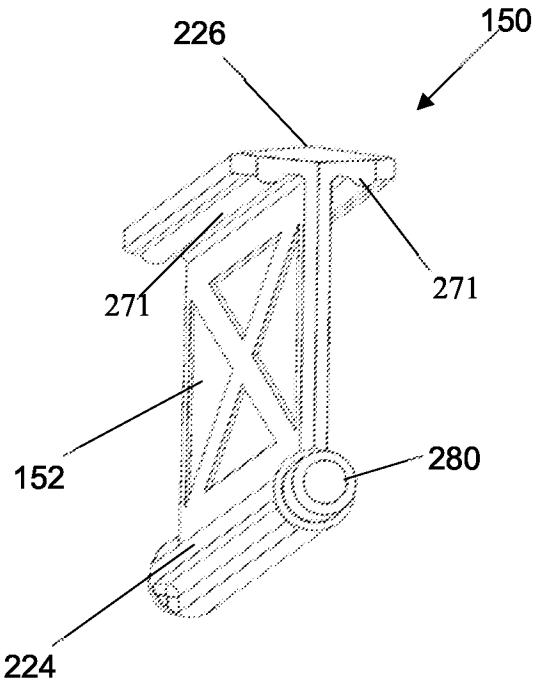
FIG. 7 is an example perspective view of an example side connector of the example organizer of FIGS. 1-5.

FIG. 7 is an example perspective view of an example side connector 150 of the example organizer of FIGS. 1-5. As noted above, the example side connectors 150 comprise a mechanical closure such as, but not limited to, a latch, a mechanical fastener, a linkage, a magnet (e.g., a rare-earth magnet, a neodymium magnet, etc.), a snap connector, a clasp, a quick release fastener or a slide lock. In the example of FIG. 7, the example side connector 150 includes, as a mechanical closure, example latch 271 disposed on or formed on an underside of the example connector 226. In some examples, the example latch 271 is only formed on an interior portion of the example connector 226 in a position to engage a corresponding latch (not shown in FIG. 7) of the example cover 300 when the cover is in a closed position. In some examples, the example latch 271 is formed on both sides of the example connector 226 so that the example side connector 150 is reversible. The inclusion of the example latch 271 on both sides of the example connector 226, as shown in FIG. 7, advantageously facilitates digital manipulation of the example side connector 150 by a user.

As noted above, an example bottom portion of the example side connector 150 includes the example shaft 224 which defines an axis of rotation about which the example side connector 150 rotates. The example side connector 150 include, on each of a first end and a second end, an example pin 280 dimensioned to be rotatably received within a corresponding one of the example openings 225 formed in the example hinge supports 223.

Figure 8:
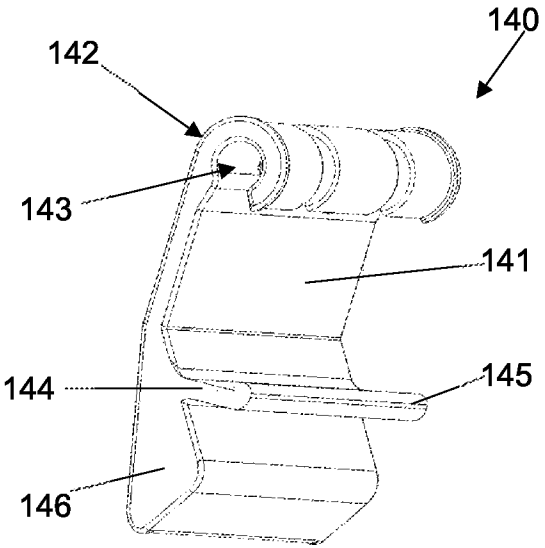
FIG. 8 is an example perspective view of an example lateral connector of the example organizer of FIGS. 1-5.

FIG. 8 is an example perspective view of an example lateral connector 140 of the example organizer of FIGS. 1-5. The example lateral connector 140 includes an example base 141 having the example snap fit joint 142 at an upper portion and an example cantilevered support 144 at a lower portion.

In the example of FIG. 8, the example cantilevered support 144 extends from the example lower portion and includes, at a distal end, an example latch 145 configured to matingly engage (e.g., a snap-fit connection, etc.) the example strike 260 (see FIG. 4) formed in the example base 200. The example lower portion of the example lateral connector 140 also includes an example lever 146.

In some examples, the example lateral connectors 140 are attached to, or integral with (e.g., formed as part of, permanently affixed to, etc.) the example cover 300. In some examples, the example lateral connectors 140 are attached to an example shaft 330 formed on the example cover 300 (see FIG. 10A). For instance, the example lateral connectors 140 are attached to the example shaft 330 via the example snap fit joint 142 which includes, in the example of FIG. 8, three example ring sections with an example opening 143. In such example, the example snap fit joint 142 is snapped onto the example shaft 330 of the example cover 300. To unlock the example lateral connector 140 of the example organizer 100, a user applies an outwardly directed (e.g., away from the example base 200) force to the example lever 146, such as through digital manipulation, to rotate the example lateral connector 140 about the example shaft 330 formed on the example cover 300 and to disengage the example latch 145 from the example strike 260 formed in the example base 200.

Figure 9:
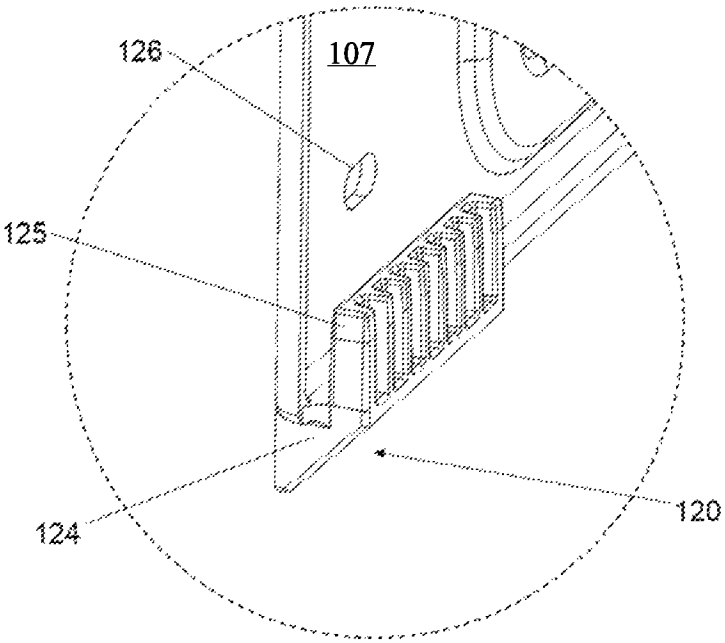
FIG. 9 is an example perspective view of an example lower support member of the example wall mount, the example lower support member being adapted to engage a bottom portion of the example organizer of FIGS. 1-5.

FIG. 9 is an example perspective view of an example lower support member 120 of the example wall mount 105 of FIGS. 1-3. The example lower support member 120 is adapted to engage a bottom portion of the example organizer 100 via example first connectors 125 configured to matingly engage example second connectors 270 on the bottom portion of the example organizer 100. In some examples, the example first connectors 125 include one of a male or a female connector and the example second connectors 270 include another one of the male or the female connector. In FIG. 9, the example first connector 125 is a male connector projecting upwardly from the example angled support 124. In some examples, the example first connectors 125 and the example second connectors 270 include interlocking teeth. In some examples, the example first connectors 125 and the example second connectors 270 are tapered in shape, with a distal portion of the example first connectors 125 having a smaller depth than a proximal portion of the example first connectors 125 (i.e., at the example angled support 124). Tapering of the example first connectors advantageously assists with positioning of the example second connectors 270 over the example first connectors 125.

FIG. 10A is an example perspective view of the example cover 300 configured to matingly engage the example base structure 200 of FIGS. 1-5. The example cover 300 includes an example base 301 and example sidewalls 302. The example base 301 defines example features 304 (see, e.g., FIG. 2), that in turn define example channels 305 on an underside of the cover, as shown in FIG. 10A. The example channels 305 formed by the example features 304 engage corresponding features (e.g., projections, male connectors, recesses, female connectors, etc.) of fixed and/or removable partitions (e.g., partitions 410), and/or junctions or posts therebetween, disposed to define a plurality of separate compartments within the example base 200. The engagement between the example channels 305 and the corresponding features of that partitions (e.g., 410) and/or junctions provides a positive connection between the example cover 300 and components borne by the example base 200 (e.g., partitions 410) at numerous points across the underside of the example cover 300. In the example of FIG. 10A, the example channels 305 form an example array of at least substantially perpendicular channels 305 in a central portion of the example cover 300. In the example of FIG. 10A, the example channels 305 circumscribe portions of an interior perimeter of the example cover 300 adjacent the example sidewalls 302 to receive upper portions of at least some portions of the example outer side walls 250 and/or other features. In some examples, the example channels 305 circumscribe an entire interior perimeter of the example cover 300 adjacent the example sidewalls 302 to receive upper portions of at least some portions of the example outer side walls 250 and/or other features. In some examples, an interior perimeter of the example cover 300 does not include example channels 305 adjacent the example sidewalls 302. In some examples, the example channels 305 define other shapes and patterns including one or more example channels 305 disposed at an angle other than 90° (e.g., 30°, 45°, 60°, 75°, etc.) relative to another one or more of the example channels 305.

In some examples, the example base 301 of the example cover 300 defines example strikes 335 (e.g., rib(s), protrusion(s), etc.) on upper lateral portions, the example strikes 335 being positioned on the example cover 300 to be engaged by the example latch 271 of the example side connector 150 to thereby secure the lateral portions of the example cover 300 to the corresponding lateral portions of the example base 200.

FIG. 10A also shows three example hinges 325 formed on or attached to a rear portion of the example cover 300 and/or the example sidewalls 302. As noted above with respect to FIG. 2, the example hinges 325 on the example cover 300 connect the example cover 300 to the example base 200. For instance, in some examples, the example hinges 325 include rotational snap-fit connectors dimensioned to rotatably connect to the example hinge bars 220 of the example base 200 to thereby enable rotation of the example cover 300 about the example hinge bars 220. While three example hinges 325 are shown in FIG. 10A, the present concepts include a lesser number (e.g., one or two) or a greater number (e.g., four, etc.) of example hinges 325. For instance, a single hinge extending along substantially an entire width of the example cover 300 and the example base 200 may be used to rotatably connect the example cover 300 and the example base 200.

The example cover 300 of the example of FIG. 10A includes, at a first end portion, two example hinge bars 330 or support structures to receive closure members (e.g., latch, clasp, lock, etc.), such as the example lateral connectors 140. In some examples, the first end of the example cover 300 also includes a centrally disposed closure member (e.g., latch, clasp, lock, etc.), such as the example central connector 315. The example central connector 315 is connected to the example cover 300. In some examples, the example central connector 315 is connected to the example cover 300 via a living hinge or living connection. In some examples, the example central connector 315 is, in a default state, biased inwardly (e.g., in a direction toward the example base 200). For instance, in some examples the example central connector 315 is biased inwardly by an angle of between 0°-20° (e.g., between 1°-2° between 1°-5°, etc.) to promote a positive engagement between the example central connector 315 and the example base 200.

In the example shown in FIG. 10A, the example central connector 315 includes an example tab 320 to facilitate an outward biasing of the example central connector 315 (e.g., a rotating of the example central connector 315 about a living hinge or living connection formed between the example cover 300 and/or example sidewalls 302, etc.) relative to the example base 200 to disengage the example first connector 322 formed or disposed on a back side of the example central connector 315 and/or the example tab 320 (i.e., facing the example base 200) from an example second connector 323 (see FIG. 10B) on the example base 200. In the example of FIG. 10A, the example first connector 322 of the example central connector 315 includes one or more projections dimensioned and positioned to snap into engagement with the example second connector 323 of the example base 200 (e.g., a ledge defined by, or attached to, a first end of the example outer side wall 250 of the example base 200, etc.). In some examples, such as is shown in the example of FIG. 10A, the example first connector 322 includes inverted triangular catches that slide into engagement with the example outer side wall 250 and lever the example central connector 315 outwardly as the example cover 300 is closed onto the example base 200. By way of example, the depicted configuration of the central connector 315 shown in FIG. 10A permits the example cover 300 to be positively latched to the example base 200 simply by rotating the example cover 300 into engagement with the example base 200, whereupon the example central connector 315 automatically engages and locks onto the example base 200 without requiring any additional manipulation by a user.

It is noted, however, that in some examples the example central connector 315 and the example first connector 322 (FIG. 10A) of the example central connector 315 is connected to, or formed on, the example base 200 rather than the example cover 300, with the corresponding example second connector 323 (see FIG. 10B) being connected to, or formed on, the example cover 300.

FIGS. 11-14 are perspective views of example adjustable wall mounts that may be used with the example organizer 100 of FIGS. 1-5, above, or may be used with another organizer (e.g., tool box, etc.) of any make (e.g., DeWalt, Husky, Stanley, Black & Decker, etc.) or model.

Figure 11:
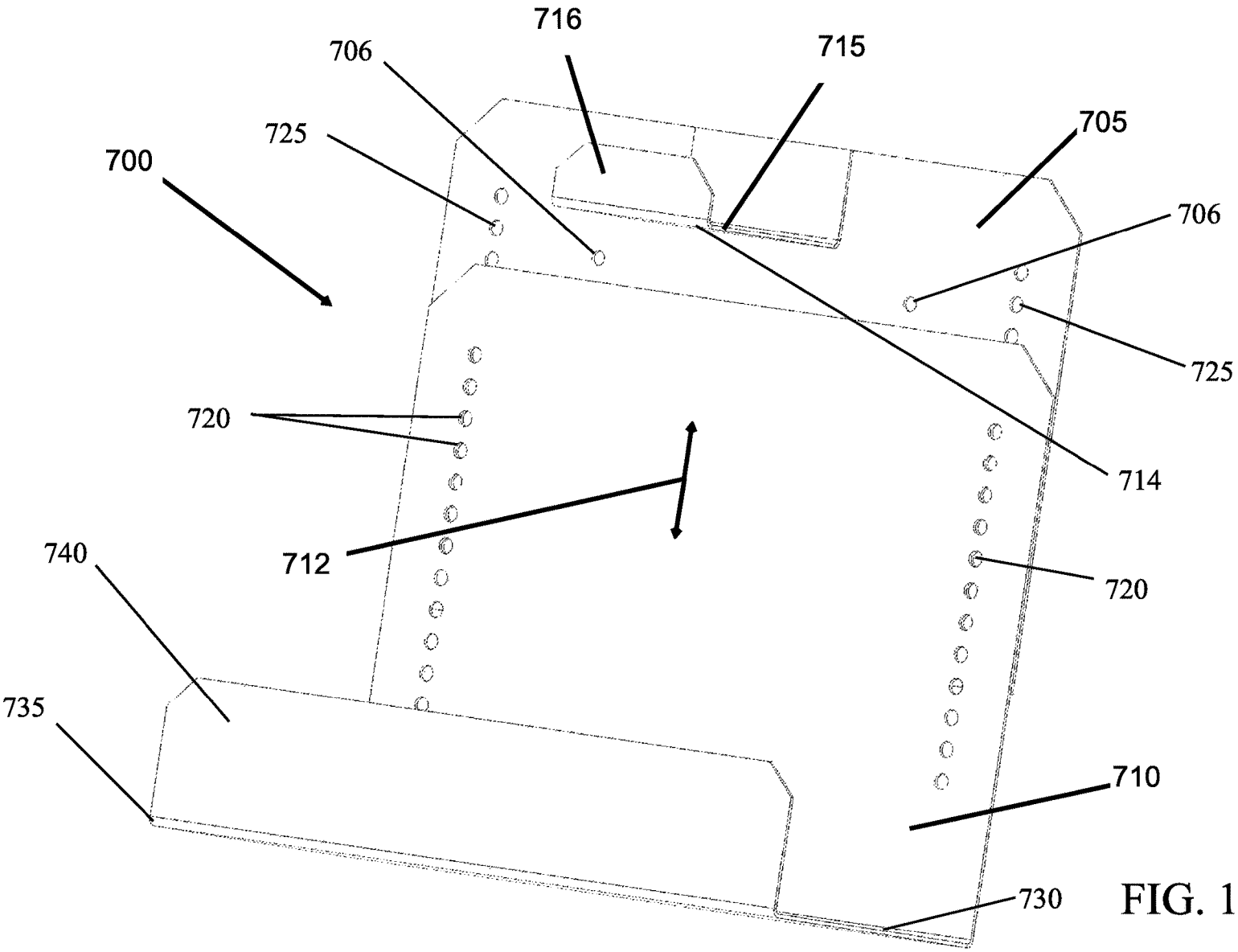
FIG. 11 is an example perspective view of an example first adjustable wall mount that may be used with the example organizer of FIGS. 1-5 or another organizer.

FIG. 11 shows an example first adjustable wall mount 700 including an example mount 705 attachable to a wall or other vertical or inclined surface (hereinafter collectively denoted as a "wall" for brevity). In some examples, the example mount 705 is attached to a wall or other vertical or inclined surface via one or more example through holes 706 through which mechanical fasteners (e.g., screws, nails, etc.) may be disposed to connect the example mount 705 to the wall. In some examples, the example mount 705 is attached to a wall via one or more adhesives or is itself attached to another mount that is secured to the wall. The example first adjustable wall mount 700 also includes an example base 710 selectively positionable relative to the example mount 705. In some examples, the example base 710 is translatable (e.g., vertically translatable and/or horizontally translatable) relative to the example mount 705. For instance, the example base 710 is translatable vertically relative to the example mount 705 in the direction(s) of the example arrow 712. In some examples, the example base 710 is secured to the example mount 705 via one or more example locking elements (not shown) to lock the example base 710 relative to the example mount 705 when the example base 710 is in a desired position relative to the example mount 705. For instance, in some examples, the one or more locking elements includes mechanical fasteners (e.g., screws, dowels, pins, pegs, etc.) inserted through a selected one or more of the example through holes 725 formed in the example mount 705 and through a selected one or more of the example through holes 720 formed in the example base 710 after alignment of the example through holes 720, 725. The mechanical fasteners (e.g., screws, etc.) are selectively removable, enabling removal of the mechanical fasteners to permit relative motion between (e.g., repositioning of) the example mount 705 relative to the example base 710. Following such repositioning, the one or more locking elements (e.g., mechanical fasteners, etc.) are secured in a desired location (e.g., inserting the one or more mechanical fasteners through aligned ones of the through holes 720, 725) to prevent relative motion between the example mount 705 and the example base 710. In some examples, the one or more locking elements include mechanical fasteners (e.g., latch(es), lock(s), clasp(s), etc.) disposed on the example mount 705 and/or the example base 710 (e.g., on lateral portions thereof) that are selectively repositionable (e.g., moved from a first state of engagement with the example base 710 to a second state of disengagement from the example base 710) to enable relative motion between the example mount 705 and the example base 710 to facilitate positioning or repositioning. In some examples, the one or more locking elements include one or more adhesives.

In some examples, the first adjustable wall mount 700 of FIG. 11 includes an example first receiver 715 to receive a handle of an organizer (e.g., the example handle 110 of the example organizer 100, etc.). In some examples, an example distal end 714 of the example first receiver 715 includes an example first retainer 716 (e.g., a flange, a plate, a post, a dorsal protrusion, a high friction interface, a magnet, etc.) to inhibit or to prevent a handle of the organizer (e.g., the example handle 110 of the example organizer 100, etc.) from moving in a forward direction away from the wall (see, e.g., example wall 106 in FIG. 1) and out of engagement with the example first receiver 715. In some examples, the example base 710 of the example first adjustable wall mount 700 includes an example second receiver 730 to receive example second end 192 of the example organizer 100 (e.g., the example second end 292 of the example base 200), or a bottom of another organizer, and to retain in place the example second end 192 of the example organizer, or bottom of another organizer. In some examples, the example second receiver 730 bears an entirety of a weight of an organizer inserted into the example first adjustable wall mount 700. In some examples, the example first receiver 715 bears an entirety of a weight of an organizer inserted into the example first adjustable wall mount 700. In some examples, the example first receiver 715 and the example second receiver 730 each bear a portion of a weight of an organizer inserted into the example first adjustable wall mount 700. In some examples, an example distal end 735 of the example second receiver 730 includes an example second retainer 740 (e.g., a flange, a plate, a post, a dorsal protrusion, a high friction interface, a magnet, etc.) to inhibit or to prevent the example second end 192 of the example organizer 100 (e.g., a second end 292 of the example base 200), or a bottom of another organizer, from moving in a forward direction away from the wall (see, e.g., example wall 106 in FIG. 1) and out of engagement with the example second receiver 730.

In the example of FIG. 11, the example first receiver 715 is integrated with the example mount 705 and the example second receiver 730 is integrated with the example base 710. In such example, the example first receiver 715 and the example mount 705 are stationary, with the example second receiver 730 and the example base 710 being translatable relative thereto. However, in some other examples, the example first receiver 715 is integrated with the example base 710 and the example second receiver 730 is integrated with the example mount 705. In such example, the example second receiver 730 is stationary, with the example first receiver 715 and the example base 710 being translatable relative thereto.

Figure 12:
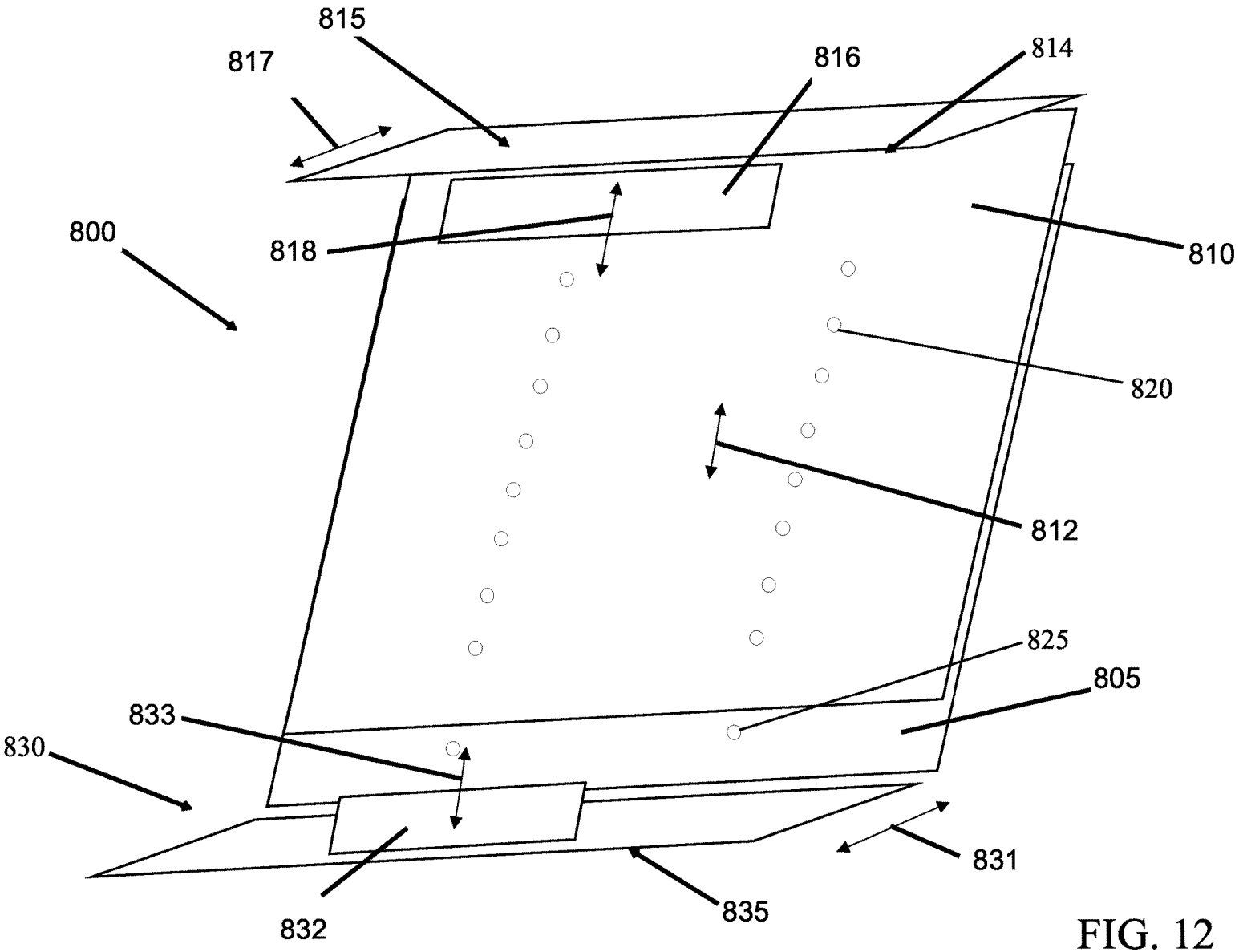
FIG. 12 is an example perspective view of an example second adjustable wall mount that may be used with the example organizer of FIGS. 1-5 or another organizer.

FIG. 12 depicts a perspective view of an example second adjustable wall mount 800 that may be used with the example organizer 100 of FIGS. 1-5 or with another organizer. FIG. 12 shows an example second adjustable wall mount 800 including an example mount 805 attachable to a wall (not shown in FIG. 12, see. e.g., FIG. 1). In some examples, the example mount 805 is attached to a wall via one or more example through holes (not shown) through which mechanical fasteners (e.g., screws, nails, etc.) may be disposed to connect the example mount 805 to the wall. In some examples, the example mount 805 is attached to a wall via one or more adhesives or is itself attached to another mount that is secured to the wall.

The example second adjustable wall mount 800 also includes an example base 810 selectively positionable relative to the example mount 805. In some examples, the example base 810 is translatable (e.g., vertically translatable and/or horizontally translatable) relative to the example mount 805. For instance, the example base 810 is translatable vertically relative to the example mount 805 in the direction(s) of the example arrow 812. In some examples, the example base 810 is secured to the example mount 805 via one or more example locking elements (not shown) to lock the example base 810 relative to the example mount 805 when the example base 810 is in a desired position relative to the example mount 805. For instance, in some examples, the one or more locking elements includes mechanical fasteners (e.g., screws, dowels, pins, pegs, etc.) inserted through a selected one or more of the example through holes 825 formed in the example mount 805 and through a selected one or more of the example through holes 820 formed in the example base 810 after alignment of the example through holes 820, 825. The mechanical fasteners (e.g., screws, etc.) are selectively removable, enabling removal of the mechanical fasteners to permit relative motion between (e.g., repositioning of) the example mount 805 relative to the example base 810. Following such repositioning, the one or more locking elements (e.g., mechanical fasteners, etc.) are secured in a desired location (e.g., inserting the one or more mechanical fasteners through aligned ones of the through holes 820, 825) to prevent relative motion between the example mount 805 and the example base 810.

In some examples, the one or more locking elements include mechanical fasteners (e.g., latch(es), lock(s), clasp(s), etc.) disposed on the example mount 805 and/or the example base 810 (e.g., on lateral portions thereof) that are selectively repositionable (e.g., moved from a first state of engagement with the example base 810 to a second state of disengagement from the example base 810) to enable relative motion between the example mount 805 and the example base 810 to facilitate positioning or repositioning. In some examples, the one or more locking elements include one or more adhesives. In some examples, rather than two tracks of example through holes 820, 825 in the example mount 805 and the example base 810, the example mount 805 and the example base 810 include a plurality of tracks of example through holes 820, 825 or include an array (e.g., a nxn or an n×m array, wherein n and m can be any integer value) to facilitate lateral positioning of the example base 810 relative to the example mount 805.

In some examples, the second adjustable wall mount 800 of FIG. 12 includes an example first receiver 815 to receive a handle of an organizer (e.g., the example handle 110 of the example organizer 100, etc.). In the example of FIG. 12, the example first receiver 815 extends outwardly from the example base 810 of the example second adjustable wall mount 800. In some examples, an example distal end 814 of the example first receiver 815 includes an example first retainer 816 (e.g., a flange, a plate, a post, a dorsal protrusion, a high friction interface, a magnet, etc.) to inhibit or to prevent a handle of the organizer (e.g., the example handle 110 of the example organizer 100, etc.) from moving in a forward direction away from the wall (see, e.g., example wall 106 in FIG. 1) and out of engagement with the example first receiver 815. In some examples, the example mount 805 of the example second adjustable wall mount 800 includes an example second receiver 830 to receive and retain an example second end 192 portion of the example organizer 100 (e.g., example second end 292 of the example base 200 of the example organizer 100), or a bottom of another organizer.

In some examples, the example second receiver 830 bears an entirety of a weight of an organizer inserted into the example second adjustable wall mount 800. In some examples, the example first receiver 815 bears an entirety of a weight of an organizer inserted into the example second adjustable wall mount 800. In some examples, the example first receiver 815 and the example second receiver 830 each bear a portion of a weight of an organizer inserted into the example second adjustable wall mount 800. In some configurations of the example second adjustable wall mount 800 of FIG. 12, the example first retainer 816 is positioned to extend downwardly beneath the example first receiver 815. In this position, the example first receiver 815 and the example first retainer do not bear any weight of the organizer, but rather laterally secure a handle of the organizer and/or another structure of the organizer (i.e., one or more portions of the organizer other than the handle) to prevent rotational movement of the organizer relative to the example second receiver 830. In some examples, the first receiver 815 and/or the first retainer 816 may be positioned to apply a compressive force (e.g., a small compressive force) against a handle of the organizer and/or another structure of the organizer to enhance engagement between the first receiver 815 and/or the first retainer 816 and the handle of the organizer and/or other structure of the organizer.

In some examples, an example distal end 835 of the example second receiver 830 includes an example second retainer 832 (e.g., a flange, a plate, a post, a dorsal protrusion, a high friction interface, a magnet, etc.) to inhibit or to prevent the example second end 192 of the example organizer 100 (e.g., example second end 292 of the example base 200) from moving in a forward direction away from the wall (see, e.g., example wall 106 in FIG. 1) and out of engagement with the example second receiver 830.

In the example of FIG. 12, the example first receiver 815 is integrated with the example base 810 and the example second receiver 730 is integrated with the example mount 805. In FIG. 12, the example second receiver 830 and the example mount 805 are stationary and the example first receiver 815 and the example base 810 are translatable relative thereto. However, in some other examples, the example first receiver 815 is integrated with the example mount 805 and the example second receiver 830 is integrated with the example base 810. In such example, the example first receiver 715 and the example base 710 are stationary, with the example second receiver 830 and the example base 810 being translatable relative thereto.

In FIG. 12, the example first receiver 815 is movable relative to the example base 810, such as in the directions indicated by the example arrow 817, and the example first retainer 816 is movable relative to the example first receiver 815, such as in the directions indicated by the example arrow 818. In some examples, the example first receiver 815 is movable, in addition to the directions indicated by the example arrow 817, or alternatively thereto, vertically relative to the example base 810 and/or rotationally relative to the example base 810 (e.g., along an axis connecting the example first receiver 815 to the example base 810). In some examples, the example first retainer 816 is movable, in addition to the directions indicated by the example arrow 818, or alternatively thereto, vertically relative to the example first receiver 815 and/or rotationally relative to the example first receiver 815 (e.g., along an axis connecting the example first receiver 815 to the example first retainer 816). In FIG. 12, the example first retainer 816 is shown to be disposed below the example first receiver 815. In some examples, the example first retainer 816 is disposed above the example first receiver 815 (see, e.g., the example retainer 116 of FIG. 1).

In some examples, the example translational movement (e.g., vertically, horizontally) of the example first receiver 815 relative to the example base 810 is implemented via a linear guide rail or linear track having one or more locking positions (e.g., locking device integrated with guide rail disposed on the example base 810) or a locking mechanism (e.g., a lever handle moving a brake unit into engagement with the guide rail, a clamp, etc.) integrated with the example first receiver 815. In some examples, the example rotational movement of the example first receiver 815 relative to the example base 810 is implemented via a locking hinge having one or more locking positions connecting the example first receiver 815 and the example base 810.

In FIG. 12, the example second receiver 830 is movable relative to the example mount 805, such as in the directions indicated by the example arrow 831, and the example second retainer 832 is movable relative to the example second receiver 830, such as in the directions indicated by the example arrow 833. In some examples, the example second receiver 830 is movable, in addition to the directions indicated by the example arrow 831, or alternatively thereto, vertically relative to the example mount 805 and/or rotationally relative to the example mount 805 (e.g., along an axis connecting the example second receiver 830 to the example mount 805). In some examples, the example second retainer 832 is movable, in addition to the directions indicated by the example arrow 833, or alternatively thereto, vertically relative to the example second receiver 830 and/or rotationally relative to the example second receiver 830 (e.g., along an axis connecting the example second receiver 830 to the example second retainer 832).

In some examples, the example translational movement (e.g., vertically, horizontally) of the example second receiver 830 relative to the example mount 805 is implemented via a linear guide rail or linear track having one or more locking positions (e.g., locking device integrated with guide rail disposed on the example mount 805) or a locking mechanism (e.g., a lever handle moving a brake unit into engagement with the guide rail, a clamp, etc.) integrated with the example second receiver 830. In some examples, the example rotational movement of the example second receiver 830 relative to the example mount 805 is implemented via a locking hinge having one or more locking positions connecting the example second receiver 830 and the example mount 805.

Figure 13:
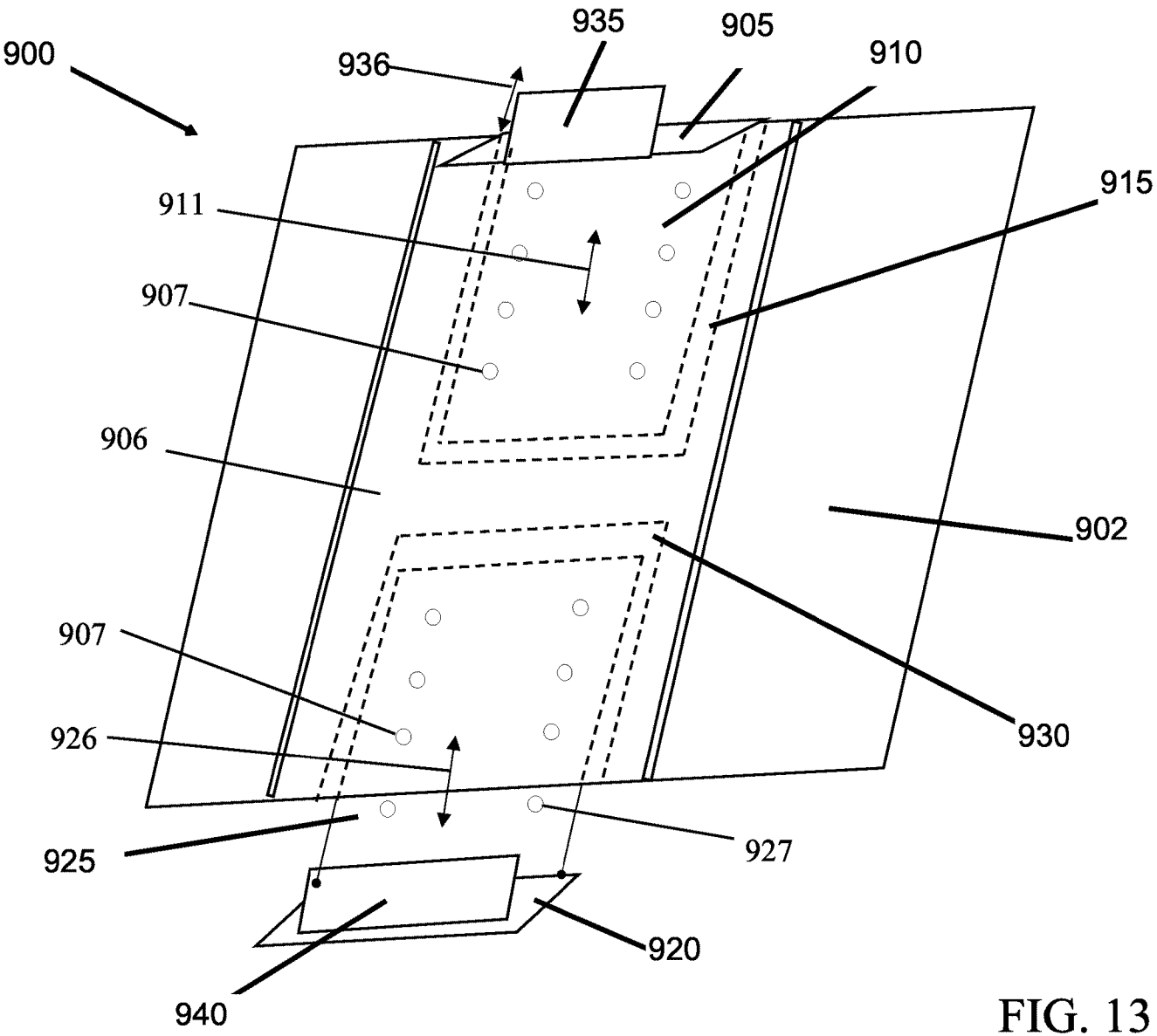
FIG. 13 is an example perspective view of an example third adjustable wall mount that may be used with the example organizer of FIGS. 1-5 or another organizer.

FIG. 13 depicts a perspective view of an example third adjustable wall mount 900 that may be used with the example organizer 100 of FIGS. 1-5 or with another organizer. FIG. 13 shows an example third adjustable wall mount 900 including an example mount 902 attachable to a wall (not shown in FIG. 13, see, e.g., FIG. 1). In some examples, the example mount 902 is attached to a wall via one or more example through holes (not shown) through which mechanical fasteners (e.g., screws, nails, etc.) may be disposed to connect the example mount 902 to the wall. In some examples, the example mount 902 is attached to a wall via one or more adhesives or is itself attached to another mount that is secured to the wall.

The example third adjustable wall mount 900 also includes an example first base 910 and an example second base 910 selectively positionable relative to the example mount 902. In some examples, the example first base 910 is translatable vertically relative to the example mount 902 within an example slot 915, as indicated by the example arrow 911. In some examples, the example second base 925 is translatable vertically relative to the example mount 902 within an example slot 930, as indicated by the example arrow 926.

In some examples, the example first base 910 and the example second base 925 are each secured to the example mount 902 via one or more example locking elements (not shown) to lock the example first base 910 and the example second base 925 relative to the example mount 902 when the example first base 910 and the example second base 925 are each in a desired position relative to the example mount 902. For instance, in some examples, the one or more locking elements includes mechanical fasteners (e.g., screws, dowels, pins, pegs, etc.) inserted through a selected one or more of example through holes 907 formed in the example mount 902 and through a selected one or more of example through holes 927 formed in the example first base 910 and the example second base 925 after alignment of the example through holes 907, 927. The mechanical fasteners (e.g., screws, etc.) are selectively removable, enabling removal of the mechanical fasteners to permit relative motion between (e.g., repositioning of) the example mount 902 relative to the example first base 910 and the example second base 925. Following such repositioning, the one or more locking elements (e.g., mechanical fasteners, etc.) are secured in a desired location (e.g., inserting the one or more mechanical fasteners through aligned ones of the through holes 907, 927) to prevent relative motion between the example mount 902 and the example first base 910 and the example second base 925.

In some examples, the one or more locking elements include mechanical fasteners (e.g., latch(es), lock(s), clasp(s), etc.) disposed on the example mount 902 that are selectively repositionable (e.g., moved from a first state of engagement with the example first base 910 and the example second base 925 to a second state of disengagement from the example first base 910 and the example second base 925) to enable relative motion between the example mount 902 and the example first base 910 and the example second base 925 to facilitate positioning or repositioning. In some examples, rather than two tracks of example through holes 907, 927 in the example mount 902 and the example first base 910 and the example second base 925, the example mount 902, the example first base 910 and the example second base 925 include a plurality of tracks of, or an array of, example through holes 907, 927.

In some examples, the third adjustable wall mount 900 of FIG. 13 includes an example first receiver 905 to receive a handle of an organizer (e.g., the example handle 110 of the example organizer 100, etc.). In the example of FIG. 13, the example first receiver 905 extends outwardly from the example first base 910, which is movably disposed within the example slot 915 of the example mount 902. In some examples, an example distal end of the example first receiver 905 includes an example first retainer 935 (e.g., a flange, a plate, a post, a dorsal protrusion, a high friction interface, a magnet, etc.) to inhibit or to prevent a handle of the organizer (e.g., the example handle 110 of the example organizer 100, etc.) from moving in a forward direction away from the wall (see, e.g., example wall 106 in FIG. 1) and out of engagement with the example first receiver 905. In some examples, the example first retainer 935 is movable (e.g., in translation and/or rotation) relative to the example first receiver 905, such as in the directions indicated by the example arrow 936 (e.g., upwardly or downwardly relative to the example first receiver 905). In some examples, the example second base 925 includes an example second receiver 920 to receive and retain the example second end 192 of the example organizer 100 (e.g., second end 292 of the example base 200). In some examples, the example first retainer 935 is rotatable relative to the first receiver 905 and/or the example second retainer 940 is rotatable relative to the second receiver 920.

In some examples, the example second receiver 920 bears an entirety of a weight of an organizer inserted into the example third adjustable wall mount 900. In some examples, the example first receiver 905 bears an entirety of a weight of an organizer inserted into the example third adjustable wall mount 900. In some examples, the example first receiver 905 and the example second receiver 920 each bear a portion of a weight of an organizer inserted into the example third adjustable wall mount 900. In some configurations of the example third adjustable wall mount 900 of FIG. 13, the example first retainer 935 is positioned to extend downwardly beneath the example first receiver 905. In this position, the example first receiver 905 and the example first retainer do not bear any weight of the organizer, but rather laterally secure a handle of the organizer and/or another structure of the organizer (i.e., one or more portions of the organizer other than the handle) to prevent rotational movement of the organizer relative to the example second receiver 920. In some examples, the first receiver 905 and/or the first retainer 935 may be positioned to apply a compressive force (e.g., a small compressive force) against a handle of the organizer and/or another structure of the organizer to enhance engagement between the first receiver 905 and/or the first retainer 935 and the handle of the organizer and/or other structure of the organizer.

In some examples, an example distal end of the example second receiver 920 includes an example second retainer 940 (e.g., a flange, a plate, a post, a dorsal protrusion, a high friction interface, a magnet, etc.) to inhibit or to prevent the example second end 192 of the example organizer 100 (e.g., the example second end 292 of the example base 200) from moving in a forward direction away from the wall (see, e.g., example wall 106 in FIG. 1) and out of engagement with the example second receiver 920.

In some examples, the example translational movement (e.g., vertically) of the example first base 910 relative to the example mount 902 is implemented via a linear guide rail or linear track having one or more locking positions or a locking mechanism (e.g., a lever handle moving a brake unit into engagement with the guide rail, a clamp, etc.) integrated with the example mount 902. In some examples, the example translational movement (e.g., vertically) of the example second base 925 relative to the example mount 902 is implemented via a linear guide rail or linear track having one or more locking positions or a locking mechanism (e.g., a lever handle moving a brake unit into engagement with the guide rail, a clamp, etc.) integrated with the example mount 902.

In the preceding examples, the example wall mount 105, the example first adjustable wall mount 700, the example second adjustable wall mount 800, the example third adjustable wall mount 900, the example lateral connectors 140, the example side connectors 150, the example base 200, the example cover 300, the example partition 440, may be made from or include one or more metals (e.g., aluminum, an alloy, etc.) and/or one or more plastics (e.g., a polymer such as, but not limited to a thermoplastic polymer, a thermosetting polymer, a phenolic resin, polyamide (PA), polycarbonate (PC), high-density polyethylene (HDPE), low-density polyethylene (LDPE), polypropylene (PP), polyvinyl chloride (PVC), acrylonitrile butadiene styrene (ABS), etc.).

In the preceding examples, a plurality of locking mechanisms (i.e., the example central connector 315, the example lateral connectors 140 and the example side connectors 150) are shown to secure the example cover (e.g., cover 300) to the example base (e.g., base 200). In some examples, the example lateral connectors 140 are omitted and the example side connectors 150 are displaced forwardly in a direction toward the upper corners of the example organizer 100 and further from the example hinge(s) 202.

In some examples, the example wall mount 105 may include an example central connector (not shown) similar to that shown by way of the example central connector 315, but sized to not only engage a corresponding feature on the example base 200 of the example organizer 100. For example, an example first connector (e.g., similar to 322) of the example central connector of the example wall mount engages an example second connector (e.g., similar to 323) of the example base 200. In some examples, the example central connector of the example wall mount 105 includes a first mechanical closure or feature (e.g., a snap connector, a ledge, a strike, a protrusion or boss, a recess, etc.) and the example base 200 includes a second mechanical closure or feature (e.g., a snap connector, a ledge, a strike, a protrusion or boss, a recess, etc.) configured to matingly engage one another to lock the example base 200 of the example organizer 100 to the example wall mount 105. In some examples, the example central connector of the example wall mount 105 is disposed at a bottom portion of the example wall mount 105 to not only lock the example organizer 100 to the example wall mount, but to also support a bottom portion of the example organizer 100. In some examples, the example central connector of the example wall mount 105 is disposed at a top portion of the example wall mount 105.

In some examples, the example central connector of the example wall mount 105 is attached to, or integral with (e.g., formed as part of, permanently affixed to, etc.), the example wall mount 105. In some examples, the example central connector of the example wall mount 105 includes an example hinge connecting the example central connector to the example wall mount 105. In some examples, the example hinge of the example central connector of the example wall mount 105 is a living hinge. In some examples, the example central connector of the example wall mount 105 is a separate part from the example wall mount 105 and the example central connector includes a first hinge element (e.g., a shaft, etc.) that is attached to corresponding second hinge element (e.g., a knuckle, a loop, joint, a node, etc.) of the example wall mount 105, with a spring or resilient element biasing the example central connector inwardly to facilitate the automatic engaging of the example mechanical closure of the example central connector with the corresponding mechanical closure or feature on the example base 200 of the example organizer 100.

In some examples, the present concepts include a wall mounted organization system including a wall mount (e.g., 105, 700, 800, 900, etc.) and including an organizer (e.g., 100, etc.) having a base (e.g., 200, etc.) and a cover (e.g., 300, etc.), the organizer defining one or more compartments (e.g., 206*a-f*, etc.) in an interior volume. The wall mounted organization system enables the storage of an example organizer on a wall or other inclined surface (e.g., a surface in a work van, etc.).

In some examples, a wall mounted organization system includes an organizer defining an interior volume accessible via a movable access door and including a first connector and a wall mount to receive the organizer, the wall mount including a second connector to engage the first connector of the tool organizer when the organizer is attached to the wall mount.

In some examples, an organizer includes a base, a cover having a proximal end rotatably connected to a proximal end of the base and a central connector disposed at a central portion of a distal end of the cover to automatically and releasably connect the central portion of the distal end of the cover to a central portion of a distal end of the base responsive to rotation of the cover into engagement with the base.

In some examples, the an organizer system includes an organizer including a base, a handle, a cover having a proximal end rotatably connected to a proximal end of the base, a central connector disposed to releasably connect a central portion of a distal end of the cover to a central portion of a distal end of the base, and one or more first connectors disposed on the proximal end of the base, the central connector including a living hinge formed at a connection between the central connector and the cover and further includes a wall mount including a first receiver and a second receiver, the first receiver dimensioned and positioned to receive and retain the handle and the second receiver including one or more second connectors disposed to matingly engage the one or more first connectors disposed on the proximal end of the base. In some examples of the preceding organizer system, the first receiver is cantilevered from the wall mount and includes a retainer at a distal end.

Although certain example apparatus, articles of manufacture and methods have been disclosed herein, the scope of coverage of this patent is not limited thereto. On the contrary, this patent covers all methods, apparatus and articles of manufacture fairly falling within the scope of the claims of this patent.

What is claimed is:

1. An organizer, comprising:

a base including a rear portion and sidewalls together defining at least one compartment and defining an opening to the at least one compartment, the base further including a first end and a second end;

a cover dimensioned to engage the sidewalls of the base to occlude the opening to the at least one compartment with the cover in a closed position, the cover including a first end and, at an end opposite to the first end, a second end, the second end of the cover being rotatably connected to the second end of the base, via at least one hinge, to place the first end of the cover adjacent the first end of the base with the cover in the closed position;

a central connector including a first connector disposed and configured to automatically lock a central portion of the first end of the cover to a second connector disposed on a central portion of the first end of the base upon closure of the cover relative to the base, the central connector only being unlocked by biasing of the first connector away from the second connector to permit rotational motion of the cover relative to the base, the first connector comprising a male locking member or a female locking member and the second connector comprising another of the male locking member or the female locking member;

a first lateral connector disposed to releasably connect a first lateral portion of the first end of the base to an adjacent first lateral portion of the first end of the cover with the cover in the closed position;

a second lateral connector disposed to releasably connect a second lateral portion of the first end of the base to an adjacent second lateral portion of the first end of the cover with the cover in the closed position, and a first side connector disposed to connect a third side of the base to a third side of the cover and a second side connector disposed to connect a fourth side of the base to a fourth side of the cover, wherein the first side connector is at least substantially centrally disposed along the third side of the base and the second side connector is at least substantially centrally disposed along the fourth side of the base.

2. The organizer of claim 1, further including a handle disposed at a central portion of at least one of the base and the cover, the handle being spaced apart from the central connector with the cover in the closed position.

3. The organizer of claim 1, wherein the first lateral connector includes, at a first end, a hinge rotatably connected to a shaft formed on the cover and includes, at a second end, a latch.

4. The organizer of claim 3, wherein the second lateral connector includes, at a first end, a hinge rotatably connected to a shaft formed on the cover and includes, at a second end, a latch.

5. The organizer of claim 1, wherein the central connector includes a living hinge formed at a connection between the central connector and the cover.

6. The organizer of claim 1, wherein the central connector includes a tab extending from the central connector.

7. The organizer of claim 1, wherein the first side connector is rotatably connected to the third side of the base and the second side connector is rotatably connected to the fourth side of the base.

8. The organizer of claim 1, further including one or more first features defined in the base to removably receive a first portion of partitions within the at least one compartment and one or more second features defined in the cover to removably receive a second portion of the partitions.

9. The organizer of claim 8, wherein the one or more first features and the one or more second features include female connectors, male connectors, or a combination of female connectors and male connectors.

10. The organizer of claim 1, wherein the second end of the base includes one or more connectors to engage matingly configured connectors of a wall mount.

* * * * *